US009574816B2

(12) United States Patent
Hamada et al.

(10) Patent No.: US 9,574,816 B2
(45) Date of Patent: Feb. 21, 2017

(54) REFRIGERATING AND AIR-CONDITIONING APPARATUS

(75) Inventors: Mamoru Hamada, Tokyo (JP); Fumitake Unezaki, Tokyo (JP); Akira Morikawa, Tokyo (JP); Satoshi Ueyama, Tokyo (JP); Koji Yamashita, Tokyo (JP); Hiroyuki Morimoto, Tokyo (JP); Yuji Motomura, Tokyo (JP); Tetsuya Yamashita, Tokyo (JP); Yusuke Otsubo, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 848 days.

(21) Appl. No.: 13/641,885

(22) PCT Filed: May 26, 2010

(86) PCT No.: PCT/JP2010/003511

§ 371 (c)(1),
(2), (4) Date: Oct. 18, 2012

(87) PCT Pub. No.: WO2011/148413

PCT Pub. Date: Dec. 1, 2011

(65) Prior Publication Data

US 2013/0031921 A1 Feb. 7, 2013

(51) Int. Cl.
*F25D 21/06* (2006.01)
*F25D 21/08* (2006.01)
(Continued)

(52) U.S. Cl.
CPC ..... *F25D 21/08* (2013.01); *F24F 13/222* (2013.01); *F25D 21/02* (2013.01); *F25D 21/14* (2013.01);
(Continued)

(58) Field of Classification Search
CPC .... F25D 21/002; F25D 21/006; F25D 21/008; F25D 21/02; F25D 21/04; F25D 21/06; F25D 21/065; F25D 21/08; F25D 21/14; F25D 29/00; F25D 2700/10
(Continued)

(56) References Cited

U.S. PATENT DOCUMENTS 3,774,406 A * 11/1973 Reitblatt ..... 62/155
4,152,900 A * 5/1979 Chopra et al. ..... 62/80
(Continued)

FOREIGN PATENT DOCUMENTS

JP 06-213555 A 8/1994
JP H0755327 A * 3/1995
(Continued)

OTHER PUBLICATIONS

Hiroyuki, Defrosting Device for Cooling Device, Mar. 3, 1995, JPH0755327A, Whole Document.*
(Continued)

*Primary Examiner* — Larry Furdge
(74) *Attorney, Agent, or Firm* — Posz Law Group, PLC

(57) ABSTRACT

A refrigeration cycle that is formed by connecting a compressor, a condenser, an expansion valve, and an evaporator and that performs cooling operation; an evaporator heating device that heats the evaporator; a drain pan that receives drain-water from the evaporator and drains the drain-water; a drain-pan heating device that heats the drain pan; a frost detecting device including a light-emitting element that emits light to the evaporator and a light-receiving element that receives reflected light from the evaporator and outputs a voltage according to the reflected light; and a control device that controls on-off operation of the evaporator heating device and the drain-pan heating device. The control device determines a frosting condition on the evaporator
(Continued)

from an output of the frost detecting device and individually controls the evaporator heating device and the drain-pan heating device in accordance with the determination result.

12 Claims, 18 Drawing Sheets

(51) Int. Cl.
*F24F 13/22* (2006.01)
*F25D 21/02* (2006.01)
*F25D 21/14* (2006.01)
*F24F 11/00* (2006.01)

(52) U.S. Cl.
CPC ..... *F24F 2011/0089* (2013.01); *F25D 2321/1413* (2013.01); *F25D 2600/02* (2013.01)

(58) Field of Classification Search
USPC ..... 62/155
See application file for complete search history.

(56) References Cited

U.S. PATENT DOCUMENTS

| | | | | |
|---|---|---|---|---|
| 4,346,755 | A * | 8/1982 | Alley et al. | 165/231 |
| 5,761,922 | A * | 6/1998 | Tamai et al. | 62/256 |
| 6,456,200 | B1 * | 9/2002 | Bostrom et al. | 340/580 |
| 2009/0235679 | A1 * | 9/2009 | Bagley | 62/140 |

FOREIGN PATENT DOCUMENTS

| | | | | |
|---|---|---|---|---|
| JP | 2001183037 | A | * | 7/2001 |
| JP | 2004-251480 | A | | 9/2004 |
| JP | 2007-178114 | A | | 7/2007 |
| JP | 2007-255811 | A | | 10/2007 |
| JP | 2007-271168 | A | | 10/2007 |
| JP | 2008-232605 | A | | 10/2008 |
| JP | 2008-304137 | A | | 12/2008 |
| JP | 2009-144951 | A | | 7/2009 |
| JP | 2010-060177 | A | | 3/2010 |
| TW | 201553 | | | 3/1993 |
| TW | 329923 | | | 4/1998 |
| TW | 468769 | | | 12/2001 |

OTHER PUBLICATIONS

International Search Report mailed on Aug. 17, 2010 for the corresponding international application No. PCT/JP2010/003511 (English translation attached).
Office Action mailed Aug. 27, 2013 issued in corresponding JP patent application No. 2012-516988 (and English translation).
Office Action dated Sep. 28, 2012 in corresponding Taiwanese Patent Application No. 099126580 (and English translation).
Office Action dated Jun. 11, 2014 issued in corresponding CN patent application No. 201080067019.8 (and English translation).

* cited by examiner

REFRIGERATING AND AIR-CONDITIONING APPARATUS

CROSS REFERENCE TO RELATED APPLICATION

This application is a U.S. national stage application of PCT/JP2010/003511 filed on May 26, 2010.

TECHNICAL FIELD

The present invention relates to a refrigerating and air-conditioning apparatus, and particularly, to a refrigerating and air-conditioning apparatus having functions of defrosting an evaporator and of heating a drain pan.

BACKGROUND ART

In the related art, a refrigerating and air-conditioning apparatus has a refrigeration cycle including a compressor, a condenser, expansion means, and an evaporator, and the refrigeration cycle is filled with a refrigerant. The refrigerant compressed by the compressor becomes a high-temperature high-pressure gas refrigerant and is sent to the condenser. The refrigerant flowing into the condenser is liquefied by releasing heat to the air. The liquefied refrigerant is decompressed to a two-phase gas-liquid state by the expansion means, and is gasified in the evaporator by absorbing heat from ambient air. The gasified refrigerant then returns to the compressor.

A refrigerated warehouse needs to be controlled such that the temperature range therein is lower than 10° C. Because the evaporating temperature of the refrigerant in this case is lower than 0° C., frost is formed on the surfaces of fins of the evaporator as time elapses. When frost is formed, the cooling capacity is lowered due to reduced airflow and increased thermal resistance, thus requiring regular defrosting operations for removing the frost.

When the defrosting operation is performed, the frost adhered to the surface of the evaporator melts and drips down. Therefore, a drain pan for receiving the so-called drain-water, that is, the dripping water, is disposed in the refrigerating and air-conditioning apparatus. The drain-water dropping onto the drain pan is drained from a drain outlet provided in the drain pan. In a case where the outside temperature is low, for example, the drain-water may freeze, making it difficult to drain the drain-water. Hence, the drain-water is prevented from freezing by attaching a heater to the drain pan.

Defrosting the evaporator and heating the drain pan more than necessary may lead to waste of power consumption as well as temperature increase in the refrigerated warehouse. Therefore, it is necessary to accurately determine the frosting condition so as to appropriately perform the defrosting and the heating at optimal timings. In the related art, there is a refrigerating apparatus in which a heat transfer member is provided in contact with both the evaporator and the drain pan, and a temperature sensor is attached to this heat transfer member. The temperature of the heat transfer member detected by the temperature sensor is detected as the temperature of both the evaporator and the drain pan. By determining the frosting condition from the detected temperature, control is performed to defrost the evaporator and to turn the drain-pan heater on and off (for example, see Patent Literature 1).

Furthermore, in the related art, there is also a refrigerating apparatus that starts defrosting operation in accordance with a predetermined defrosting cycle regardless of the frosting condition.

CITATION LIST

Patent Literature

Patent Literature 1: Japanese Unexamined Patent Application Publication No. 2004-251480 (pages 4 and 5, FIG. 1)

SUMMARY OF INVENTION

Technical Problem

In the refrigerating apparatus according to Patent Literature 1 mentioned above, the frosting condition on the evaporator is indirectly presumed by using the temperature of the heat transfer member. Therefore, the accuracy for determining the frosting condition is not sufficient, and a threshold temperature to be used for determining when to end the defrosting operation thus needs to be set on the safe side, that is, to a temperature at which the frost can be properly removed. In this case, there are problems such as an increase in power consumption due to excessive energization of the heater, as well as an increase in temperature in the refrigerated warehouse.

Moreover, in the refrigerating apparatus according to Patent Literature 1, the defrosting of the evaporator and the heating of the drain pan are started at the same timing. However, the drain-water begins to drip down onto the drain pan when the frost starts to melt by being increased in temperature to 0° C. or higher after starting the defrosting operation of the evaporator. This means that the start timing for heating the drain pan and the start timing for defrosting the evaporator do not necessarily need to be the same. Although it is desirable that the defrosting start-end control of the evaporator and the on-off control of the drain-pan heater be performed at accurate timings, as mentioned above, this is not sufficiently fulfilled with the technology according to Patent Literature 1 described above in actuality.

Furthermore, in the refrigerating apparatus that starts the defrosting operation according to the predetermined defrosting cycle, the defrosting operation is periodically started regardless of the frosting condition. Specifically, even if there is only a small amount of frost and defrosting is thus not necessary, the defrosting operation is forcibly performed in accordance with the defrosting cycle. This may lead to problems such as increased power consumption and quality degradation of stored items caused by temperature increase in the refrigerated warehouse.

The invention has been made to solve the aforementioned problems, and an object thereof is to provide a refrigerating and air-conditioning apparatus that directly detects the frosting condition on an evaporator and individually performs on-off control of a drain-pan heater and defrosting start-end control of the evaporator at optimal timings on the basis of the detection result.

Another object is to provide a refrigerating and air-conditioning apparatus that directly detects the frosting condition on an evaporator and determines when to start the defrosting operation on the basis of the frosting condition.

Solution to Problem

A refrigerating and air-conditioning apparatus according to the invention includes a refrigeration cycle being formed by connecting a compressor, a condenser, expansion means, and an evaporator, the refrigeration cycle performing a cooling operation; an evaporator heating device heating the evaporator; a drain pan receiving drain-water from the evaporator and draining the drain-water; a drain-pan heating device heating the drain pan; frost detecting means including a light-emitting element that emits light to the evaporator and a light-receiving element that receives reflected light from the evaporator and outputs a voltage according to the reflected light; a control device controlling on-off operation of the evaporator heating device and the drain-pan heating device, the control device determining a frosting condition on the evaporator from an output of the frost detecting means and individually controlling the evaporator heating device and the drain-pan heating device in accordance with the determination result.

Advantageous Effects of Invention

According to the invention, the frosting condition on an evaporator is directly detected so that the defrosting of the evaporator and the heating of the drain pan can be performed individually at optimal timings on the basis of the detection result.

DESCRIPTION OF EMBODIMENTS

Embodiment 1

Figure 1:
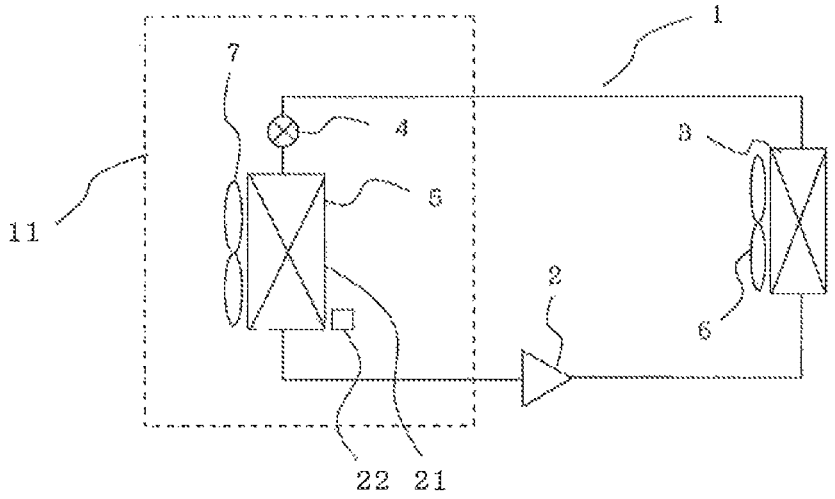
FIG. 1 is a schematic diagram illustrating a refrigerating and air-conditioning apparatus according to Embodiment 1 of the invention.
Figure 2:
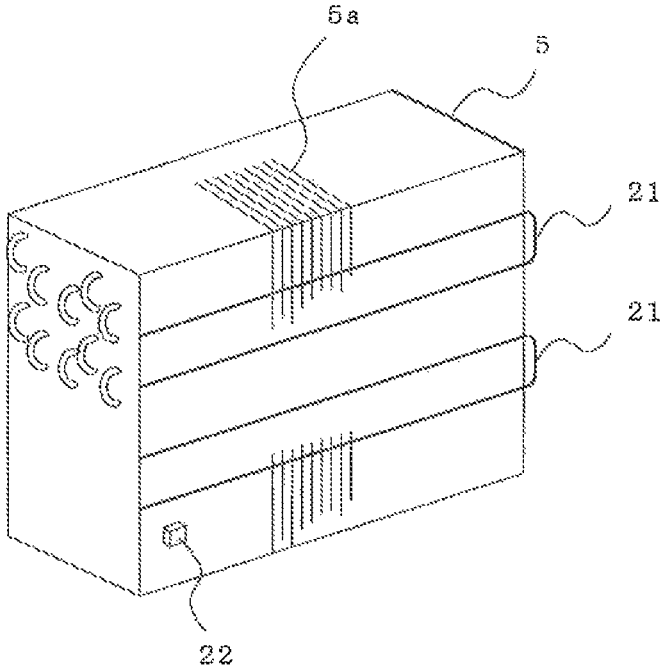
FIG. 2 is an enlarged schematic perspective view of an evaporator of FIG. 1.
Figure 3:
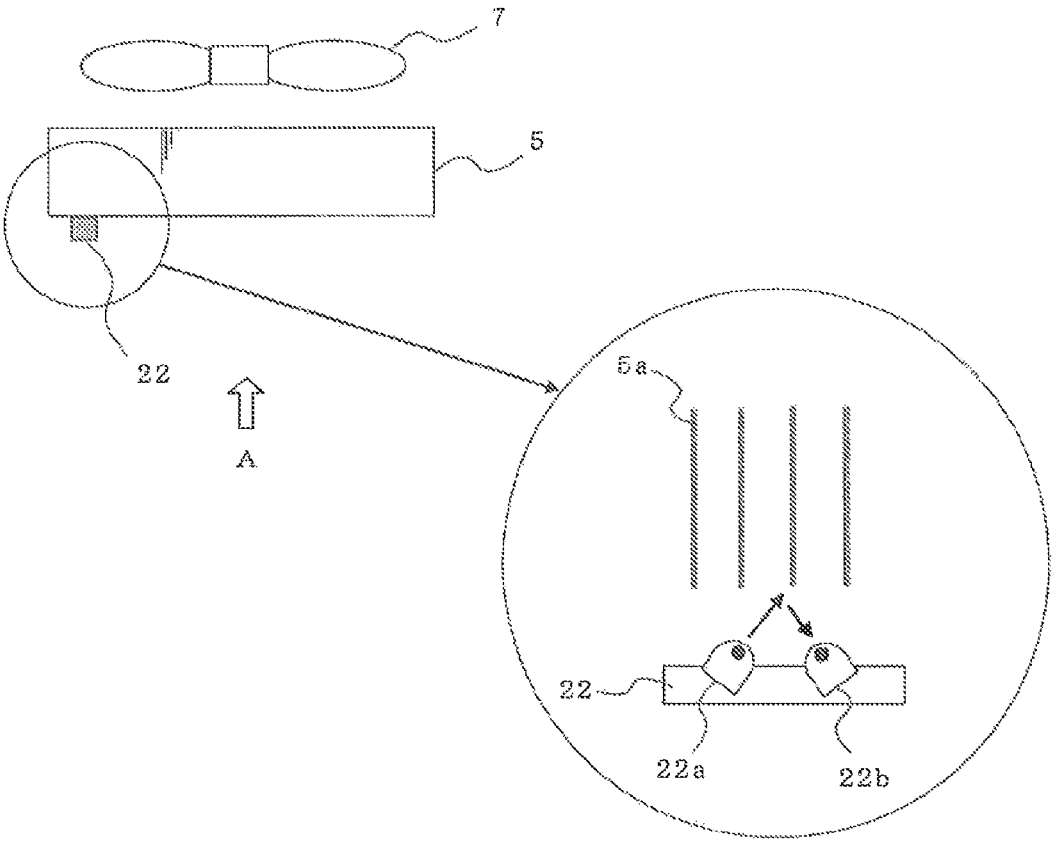
FIG. 3 is an enlarged schematic view of a surrounding area including the evaporator of FIG. 1.
Figure 4:
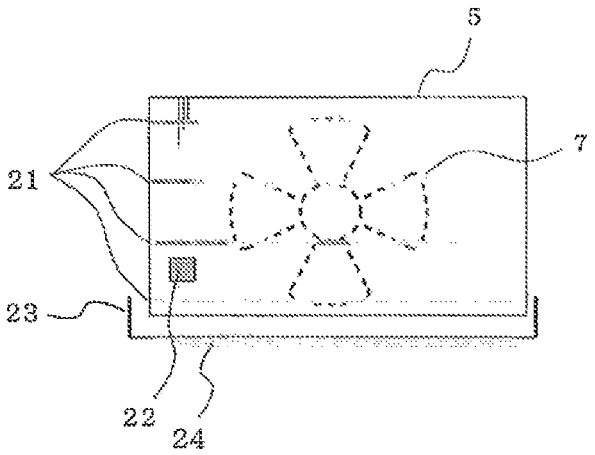
FIG. 4 is a front view of the surrounding area including the evaporator, as viewed from a direction of an arrow A in FIG. 3.

FIG. 1 is a schematic diagram illustrating a refrigerating and air-conditioning apparatus according to Embodiment 1 of the invention. FIG. 2 is an enlarged schematic perspective view of an evaporator of FIG. 1. FIG. 3 is an enlarged schematic view of a surrounding area including the evaporator of FIG. 1. FIG. 4 is a front view of the surrounding area including the evaporator, as viewed from a direction of an arrow A in FIG. 3.

A refrigerating and air-conditioning apparatus 1 according to Embodiment 1 of the invention includes a compressor 2, a condenser 3, an expansion valve 4 as expansion means, an evaporator 5, a condenser fan 6 as an air-sending device for the condenser, and an evaporator fan 7 as an air-sending device for the evaporator. The evaporator 5 and the evaporator fan 7 are disposed in a refrigerated warehouse 11.

The evaporator 5 is constituted by a fin-tube heat exchanger and includes multiple fins 5*a*. An evaporator heater 21 serving as an evaporator-heating device for defrosting the evaporator 5, and frost detecting means 22 that detects the frosting condition on the evaporator 5 are attached to the evaporator 5. A drain pan 23 that collects drain-water from the evaporator 5 and that drains the water is provided below the evaporator 5. A drain-pan heater 24 serving as a drain-pan heating device for heating the drain pan 23 is provided at the bottom surface of the drain pan 23.

As shown in FIG. 3, the frost detecting means 22 includes a light-emitting element 22*a* formed of a low-cost light-emitting diode (LED) that can emit light having a wavelength in the infrared range, and a light-receiving element 22*b* similarly formed of a low-cost light-emitting diode (LED). Although LEDs (light-emitting diodes) convert electric current to light, they are in the same group as photodiodes (solar cell) since they structurally utilize a junction of p-type and n-type semiconductors. When light is emitted to the p-n junction of the semiconductors, the p-side acquires a positive potential and the n-side acquires a negative potential, whereby photovoltaic power is generated. The light-receiving element 22*b* formed of an LED in Embodiment 1 constitutes a reverse-bias circuit that converts light intensity to a time axis and obtains an output by evaluating the length of time. Accordingly, since the light-emitting element 22*a* and the light-receiving element 22*b* are both formed of low-cost LEDs, the frost detecting means 22 can be manufactured at an extremely low cost and can also be made compact. In addition, since light having a wavelength in the infrared range is less likely to be affected by ambient light, the detection sensitivity is less susceptible to the ambient environment.

As shown in FIG. 3, the frost detecting means 22 having the above-described configuration is disposed such that the light from the light-emitting element 22*a* is emitted toward the fins 5*a* that are frost formation members, and the light reflected therefrom is received by the light-receiving element 22*b*. The frost detecting means 22 is connected to a control device 25, to be described below. The control device 25 calculates a light intensity P from an output of the light-receiving element 22*b* and determines the frosting condition on the basis of the light intensity P.

Figure 5:
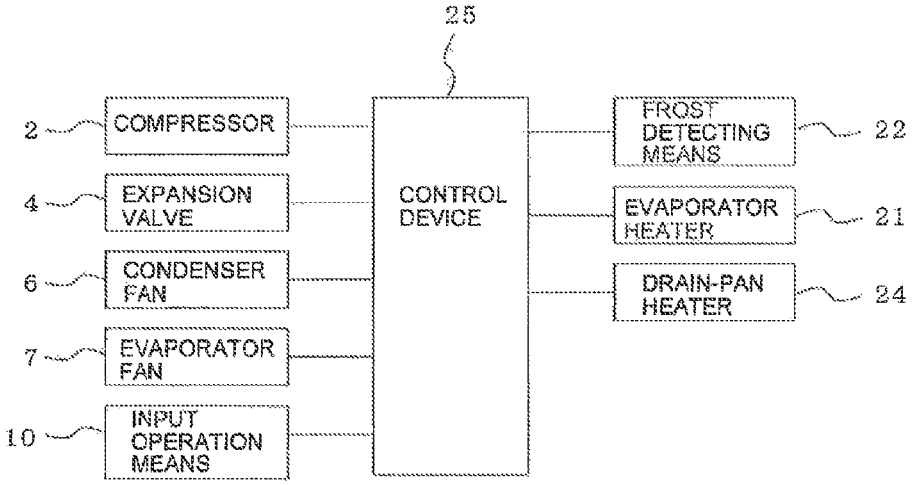
FIG. 5 is a block diagram illustrating an electrical configuration of the refrigerating and air-conditioning apparatus according to Embodiment 1 of the invention.

FIG. 5 is a block diagram illustrating an electrical configuration of the refrigerating and air-conditioning apparatus according to Embodiment 1 of the invention. In FIG. 5, components that are the same as those in FIG. 1 are given the same reference numerals.

As shown in FIG. 5, the refrigerating and air-conditioning apparatus 1 includes the control device 25 that controls the entire refrigerating and air-conditioning apparatus 1. The control device 25 is connected to the compressor 2; the expansion valve 4; the condenser fan 6; the evaporator fan 7; input operation means 10 through which a power switch, the temperature, and the like can be set; the frost detecting means 22; the evaporator heater 21; and the drain-pan heater 24. The control device 25 controls the compressor 2, the expansion valve 4, the condenser fan 6, and the evaporator fan 7 on the basis of a signal from the input operation means 10, calculates the light intensity P from an output of the light-receiving element 22*b* of the frost detecting means 22, determines the frosting condition on the basis of the light intensity P, and performs control in accordance with a flowchart, to be described below. Specifically, the control device 25 is formed of a microcomputer.

When cooling operation is started in the refrigerating and air-conditioning apparatus 1 having the above-described configuration, a refrigerant compressed by the compressor 2 is turned into a high-temperature high-pressure gas refrigerant and is sent to the condenser 3. The refrigerant flowing into the condenser 3 is liquefied by releasing heat to air introduced by the condenser fan 6. The liquefied refrigerant flows into the expansion valve 4. The refrigerant in the liquid state is decompressed to a two-phase gas-liquid state by the expansion valve 4 and is sent to the evaporator 5. Then, the refrigerant is gasified by absorbing heat from air introduced by the evaporator fan 7 so as to exhibit a cooling effect. The gasified refrigerant then returns to the compressor 2. By repeating this cycle, the interior of the refrigerated warehouse 11 is cooled.

Figure 6:
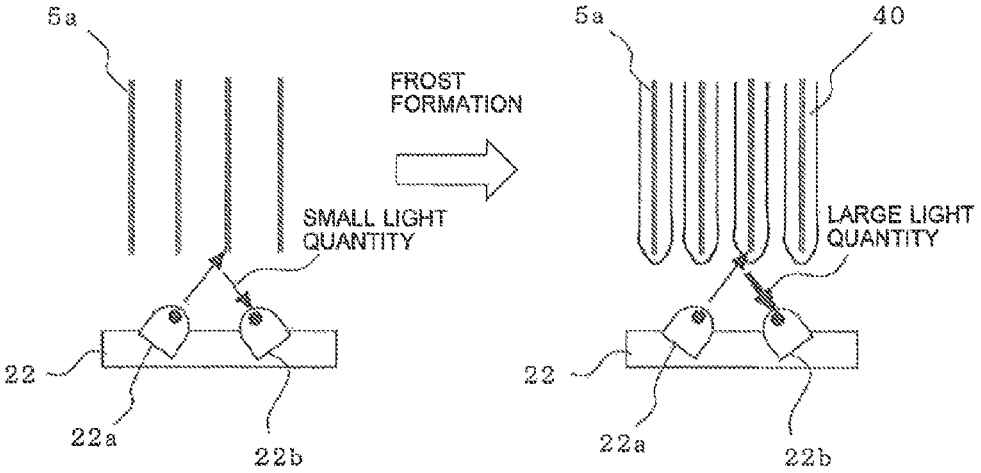
FIG. 6 illustrates the quantity of reflected light detected by frost detecting means according to Embodiment 1 of the invention when there is no frost and when frost is formed.

When the evaporating temperature in the evaporator 5 is 0° C. or lower, the moisture in the air adheres to the evaporator 5 and is accumulated as frost 40, as shown in FIG. 6. The accumulated amount increases with time. As a result, due to an increase in thermal resistance and airflow resistance caused by the frost 40 adhered to the fins 5*a* constituting the evaporator 5, the cooling capacity decreases with time, as shown in FIG. 7.

Figure 7:
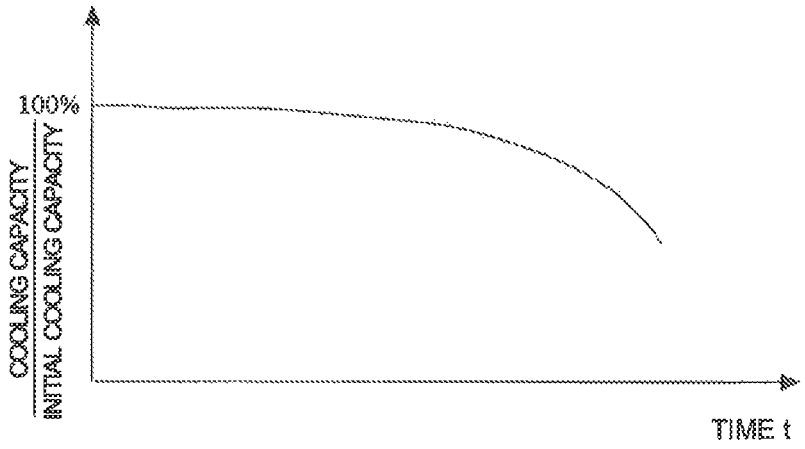
FIG. 7 illustrates a temporal change in cooling capacity in Embodiment 1 of the invention.

FIG. 7 is a graph illustrating how the cooling capacity decreases due to the frost adhered to the evaporator. The horizontal axis denotes time, whereas the vertical axis denotes the percentage of the cooling capacity relative to the initial cooling capacity.

It is apparent from FIG. 7 that, when frost adheres to the evaporator 5, the cooling capacity is gradually decreased.

Therefore, the evaporator 5 of the refrigerating and air-conditioning apparatus 1 used in the refrigerated warehouse 11 is provided with the evaporator heater 21. Defrosting operation is performed by utilizing the heat of the evaporator heater 21 so that the frost can be melted. Moreover, during the defrosting operation, the drain pan 23 serving as a drain-water receiver is heated by the drain-pan heater 24 so that the drain-water is prevented from freezing again.

Figure 8:
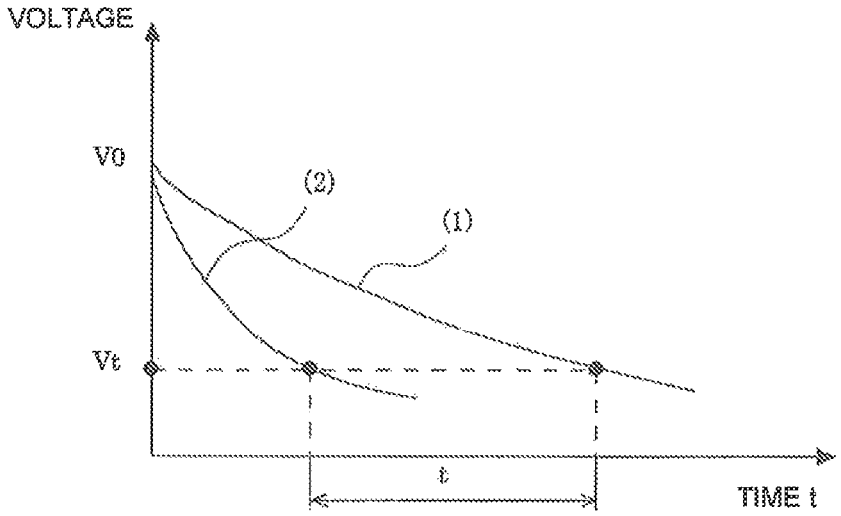
FIG. 8 is a graph illustrating the relationship between time and the electric potential when a light-receiving element of FIG. 3 discharges electricity.

When the frost 40 adheres to the fins 5*a* of the evaporator 5 as shown in FIG. 6, light emitted from the light-emitting element 22*a* of the frost detecting means 22 is reflected and absorbed by the frost 40, and the reflected light is received by the light-receiving element 22*b*. The light-receiving element 22*b* is preliminarily supplied and charged with a reverse bias voltage and discharges electricity by receiving the reflected light so as to detect the quantity of reflected light from the frost 40. FIG. 8 illustrates the relationship between time and the electric potential when the light-receiving element 22*b* discharges electricity. In FIG. 8, (1) denotes a reference graph corresponding to when the quantity of light received by the light-receiving element 22*b* is zero, and (2) denotes a graph corresponding to when the quantity of reflected light is detected by the light-receiving element 22*b*. By measuring the time it takes to reach a certain voltage Vt, the light intensity P can be determined. The relationship between the light intensity P and the time t that it takes to reach the voltage Vt can be expressed by the following equation, and the light intensity P can be determined therefrom.

$$P = \frac{aQ_0}{t}\left(\frac{1}{Vt} - \frac{1}{V_0}\right) \quad \text{[Math. 1]}$$

In this case, a denotes a constant, $Q_0$ denotes an electric charge amount of the light-receiving element 22*b*, and $V_0$ denotes an electric potential at a time point 0.

Figure 9:
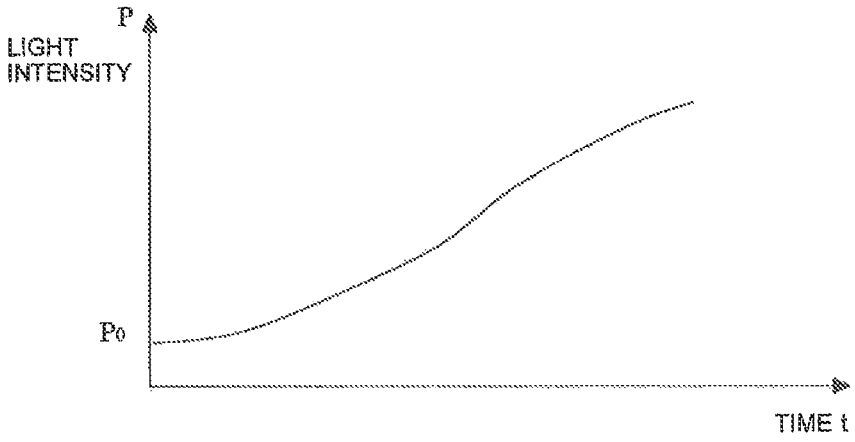
FIG. 9 illustrates a change in light intensity (or may be the relationship between voltage and time) when changing from a state in which frost is not adhered to the surfaces of fins 5*a* to a state in which frost is formed thereon.

FIG. 9 illustrates a change in light intensity (or may be the relationship between voltage and time) when changing from a state in which frost is not adhered to the surfaces of the tins 5*a* to a state in which frost is formed thereon.

Because scattering light increases as the amount of frost increases with time, the quantity of light returning to the light-receiving element 22*b* increases, causing the light intensity (or the voltage) to gradually increase. $P_0$ denotes the light intensity of reflected light from the fins 5*a* when there is no frost. It is apparent from FIG. 9 that the light intensity P gradually increases from the light intensity $P_0$ as time elapses, and that the light intensity P and the amount of frost have a correlative relationship. Therefore, the amount of frost can be determined from the light intensity by utilizing this relationship. Consequently, in Embodiment 1, the relationship between the amount of frost and the light intensity is obtained in advance from tests, and control of starting defrosting operation is performed when the amount of frost formed during an operation reaches an amount of frost at its limit to maintain a desired cooling capacity (corresponding to a limit amount of frost at which the desired cooling capacity cannot be obtained if the amount of frost becomes greater than or equal to this amount of frost). Specifically, the light intensity corresponding to when the amount of frosting is at its limit to maintain a desired cooling capacity (a light intensity smaller than or equal to this light intensity will be referred to as "light intensity Ps") is determined in advance, and when the light intensity P during operation reaches the light intensity Ps, control of starting the defrosting operation may be performed.

The following description relates to how the light intensity P changes when the defrosting operation is started in the state where frost is adhered to the surfaces of the fins 5*a*.

Figure 10:
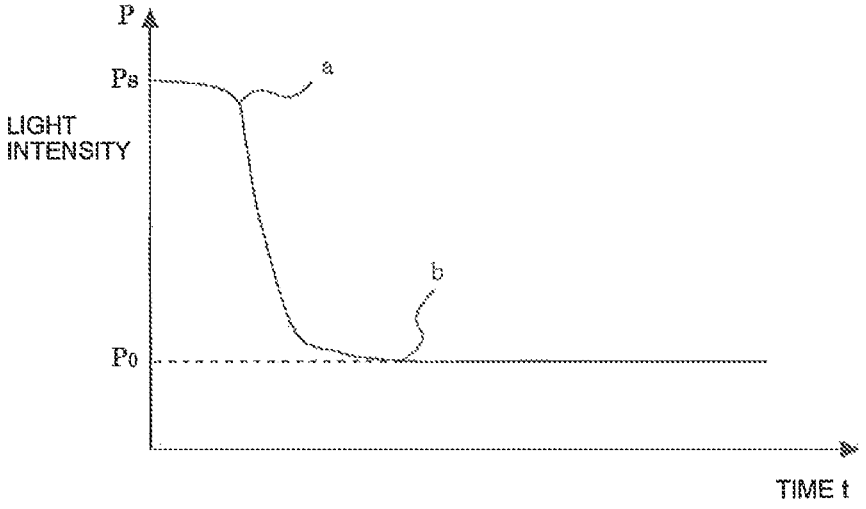
FIG. 10 illustrates a change in light intensity (may also be the relationship between voltage and time) when changing from a state in which frost is adhered to the surfaces of the fins 5*a* to a state in which there is no frost, from a start of a defrosting operation.

FIG. 10 illustrates a change in light intensity (may also be the relationship between voltage and time) when changing from a state in which frost is adhered to the surfaces of the fins 5*a* to a state in which there is no frost, from the start of the defrosting operation.

When the defrosting operation is started, the temperature of the frost gradually increases. When the temperature of the frost reaches 0° C., the frost begins to melt. In this case, because the degree of transparency of the frost increases, the quantity of scattering light decreases. Thus, the quantity of light returning to the light-receiving element 22*b* decreases, causing the light intensity (or the voltage) to start decreasing rapidly (point a in FIG. 10). Subsequently, the light intensity (voltage) decreases as the frost is removed, and when the frost and dew are completely removed from the surface of the evaporator 5 (point b in FIG. 10), the light intensity (voltage) becomes stable at $P_0$ ($V_0$). Therefore, by preliminarily performing tests to measure the change in the light intensity P after starting the defrosting operation from the light intensity Ps state so as to ascertain the change in light intensity corresponding to the frosting condition, the current frosting condition can be determined from a detection result of the frost detecting means 22 during operation.

If the start of defrosting operation is delayed and the cooling operation continues while the desired cooling capacity is still not obtained, there is a possibility of lack of cooling in the refrigerated warehouse 11. Moreover, if the defrosting operation is not terminated in time and is thus performed more than necessary, not only the power consumption during the defrosting operation increases, but also the temperature in the refrigerated warehouse 11 increases. Thus, power is required for reducing the increased temperature to a predetermined temperature, resulting in waste of energy. Furthermore, when the temperature in the refrigerated warehouse 11 increases, the quality of items stored in the refrigerated warehouse 11 is degraded, resulting in loss. In other words, it is important to optimize the start and end timings of the defrosting operation so that sufficient and necessary defrosting operation is performed. Moreover, with regard to the heating start and end timings of the drain pan 23, it is similarly important to determine optimal timings for saving energy and for preventing quality degradation.

Figure 11:
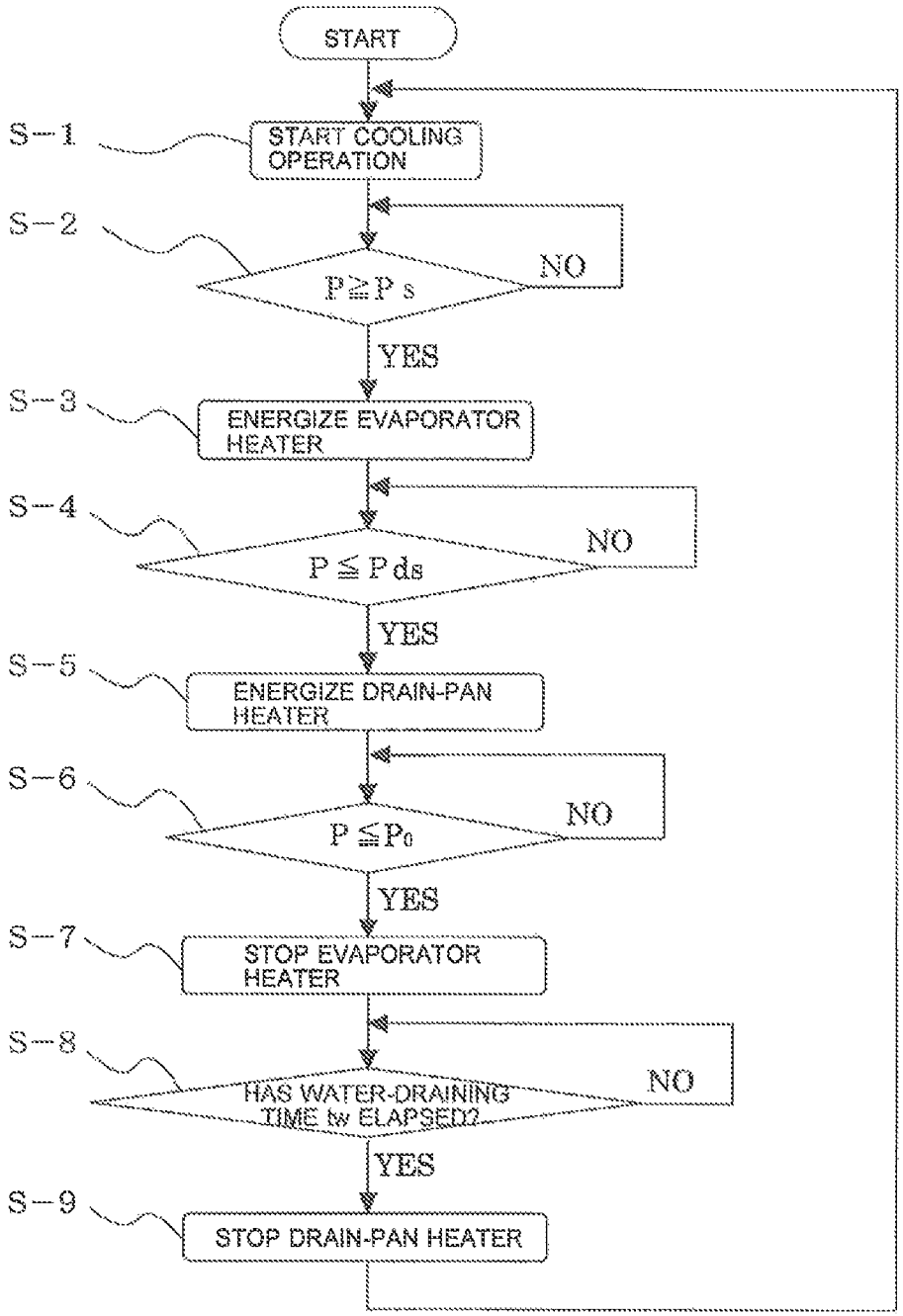
FIG. 11 is a flowchart illustrating an operation action based on an output of the frost detecting means in the refrigerating and air-conditioning apparatus according to Embodiment 1.
Figure 12:
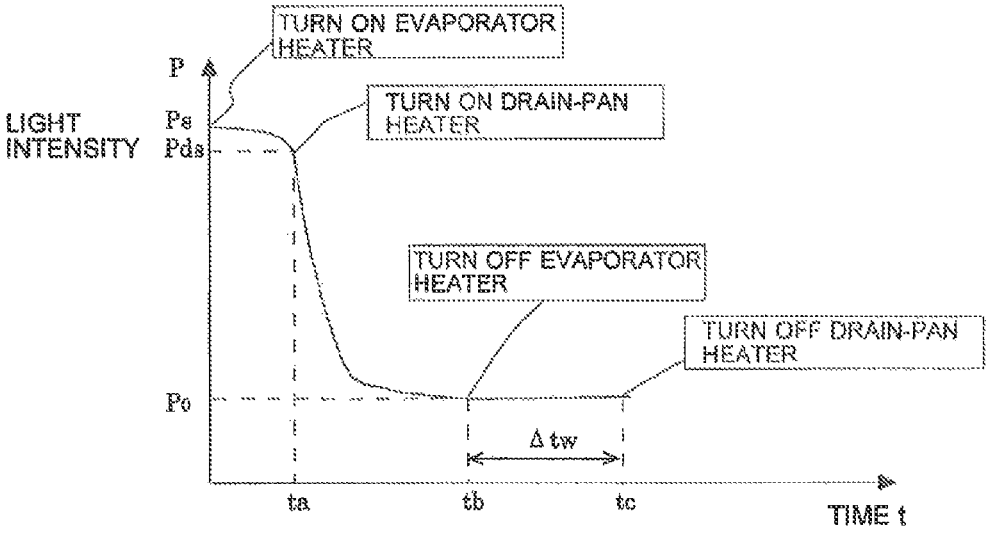
FIG. 12 illustrates a change in light intensity P when control is performed in accordance with the flowchart of FIG. 11.

Subsequently, description of an operation action based on an output of the frost detecting means 22 in the refrigerating and air-conditioning apparatus 1 according to Embodiment 1 will be given with reference to a flowchart of FIG. 11. FIG. 12 illustrates a change in the light intensity P when control is performed in accordance with the flowchart of FIG. 11, and shows ON and OFF timings of the evaporator heater 21 and the drain-pan heater 24.

Upon receiving a command to start the cooling operation from the input operation means (S-1), the control device 25 starts the cooling operation by driving the compressor 2 and the like, and calculates the light intensity P (voltage) from an output of the light-receiving element 22*b* of the frost detecting means 22. Then, it is determined whether or not the calculated light intensity P is greater than or equal to the predetermined light intensity Ps (Von) (S-2). If it is determined that the light intensity P is greater than or equal to Ps (Von), defrosting operation is started. Specifically, the evaporator heater 21 is energized so as to defrost the evaporator 5 (S-3).

The control device 25 determines whether or not the light intensity P (voltage) calculated on the basis of the output of the frost detecting means 22 is smaller than or equal to a predetermined light intensity Pds (Vdon) (S-4). Then, when the light intensity P (voltage) is smaller than or equal to Pds (Vdon), it is determined that the frost on the evaporator 5 has started to melt, and the drain-pan heater 24 is energized (S-5). With regard to the light intensity Pds, a change in the light intensity P after starting the defrosting operation from the light intensity Ps state may be measured in advance from tests, and based on the measurement result, the light intensity corresponding to when the light intensity P starts to decrease rapidly may be set as the light intensity Pds. In FIG. 12, time to corresponds to when the frost on the evaporator 5 starts to melt after the start of defrosting operation.

Then, the control device 25 determines whether or not the light intensity P (voltage) calculated on the basis of the output of the frost detecting means 22 is smaller than or equal to $P_0$ (S-6). If it is determined that the calculated light intensity P is smaller than or equal to $P_0$, it is determined that there is no frost or dew on the evaporator 5, and the energization of the evaporator heater 21 is stopped (S-7), whereby the defrosting operation of the evaporator 5 is ended. In FIG. 12, time tb corresponds to when the frost or dew is removed from the evaporator 5 after the start of defrosting operation.

Subsequently, the control device 25 determines whether or not a predetermined water-draining time Δtw has elapsed after stopping the energization of the evaporator heater 21 (S-8). Then, when the water-draining time Δtw has elapsed, the energization of the drain-pan heater 24 is stopped (S-9), whereby the defrosting operation is ended at time tc at which the cooling operation is resumed.

Figure 13:
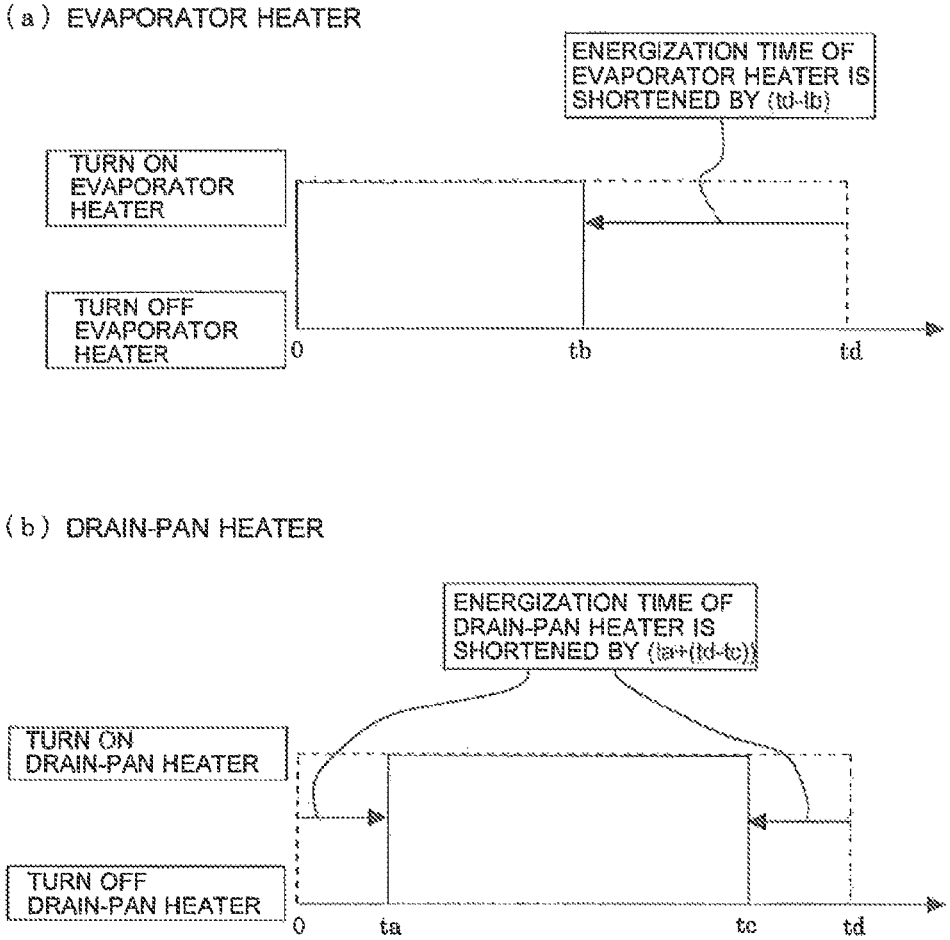
FIG. 13 illustrates an energization time of an evaporator heater and an energization time of a drain-pan heater.

FIG. 13 illustrates an energization time of the evaporator heater 21 and an energization time of the drain-pan heater 24, and includes diagram (a) corresponding to that of the evaporator heater 21 and diagram (b) corresponding to that of the drain-pan heater 24. In FIG. 13, a solid line denotes the energization time according to Embodiment 1, whereas a dotted line denotes the energization time based on a method of the related art determining when to end the defrosting operation using a temperature sensor.

In the related art determining when to end the defrosting operation using a temperature sensor, if the defrosting time required in the control in which the simultaneous energization of the evaporator heater 21 and the drain-pan heater 24 and simultaneous stopping of the energization is defined as td, then, the energization time of the evaporator heater 21 is shortened by (td−tb) seconds and the energization time of the drain-pan heater 24 is shortened by (ta+(td−tc)) seconds, as shown in FIG. 13, based on the control according to Embodiment 1.

For example, when an operation is performed in a state where the refrigerated warehouse temperature is 0° C. and the evaporating temperature is −20° C., time ta at which the frost starts to melt is at about 350 seconds, time tb at which the frost is removed from the evaporator 5 is at about 1100 seconds, and time to at which water-draining is completed is at about 1600 seconds. In this case, because the defrosting time td in normal control is at about 1800 seconds, the energization time of the evaporator heater is shortened by 700 seconds (39%), and the energization time of the drain-pan heater 24 is shortened by about 550 seconds (31%). Accordingly, with the shortened energization times of the heaters, power consumption can be reduced, and temperature increase in the refrigerated warehouse can be suppressed.

According to Embodiment 1, the frosting condition on the fins 5*a* that are frost formation members of the evaporator 5 is directly detected by the frost detecting means 22 so that the progression of frost formation and the progression of defrosting can be finely ascertained from the detection result. Thus, with regard to the defrosting start and end timings of the evaporator 5 and the heating start and end timings of the drain pan 23, optimal timings can be determined. Since the evaporator heater 21 and the drain-pan heater 24 are individually controlled in accordance with the determined timings, the defrosting of the evaporator 5 and the heating of the drain pan 23 can be minimized so that waste of power consumption can be reduced, thereby allowing increased energy efficiency as well as suppressing temperature increase in the refrigerated warehouse.

Specifically, since the evaporator heater 21 is turned on at a timing when the frosting condition on the evaporator 5 reaches a frosting condition at its limit to allow the desired cooling capacity to be maintained, the defrosting operation can be started at a necessary timing. In this case, since only the evaporator heater 21 is turned on while the drain-pan heater 24 is not turned on, energy can be saved, as compared with the method of the related art in which the evaporator heater 21 and the drain-pan heater 24 are simultaneously turned on.

Furthermore, the timing at which the frost starts to melt and the drain-water starts to drip down onto the drain pan 23 can be accurately determined from the detection result of the frost detecting means 22, and this timing is set as an ON timing of the drain-pan heater 24. Therefore, the heating of the drain pan 23 can be started at a practically necessary timing.

Moreover, because the drain-pan heater 24 is to be turned off when the water-draining time, which is preliminarily determined from tests, has elapsed after turning off the evaporator heater 21, the heating of the drain pan 23 can be ended accurately at a necessary timing.

Embodiment 2

Although the frosting condition is determined by using an absolute value of the light intensity (voltage) obtained by the frost detecting means 22 in Embodiment 1 described above, the absolute value of the light intensity (voltage) relative to the frosting condition may vary depending on aged degradation (such as a stained optical surface). Embodiment 2 is an embodiment based on an assumption of such a case.

Figure 14:
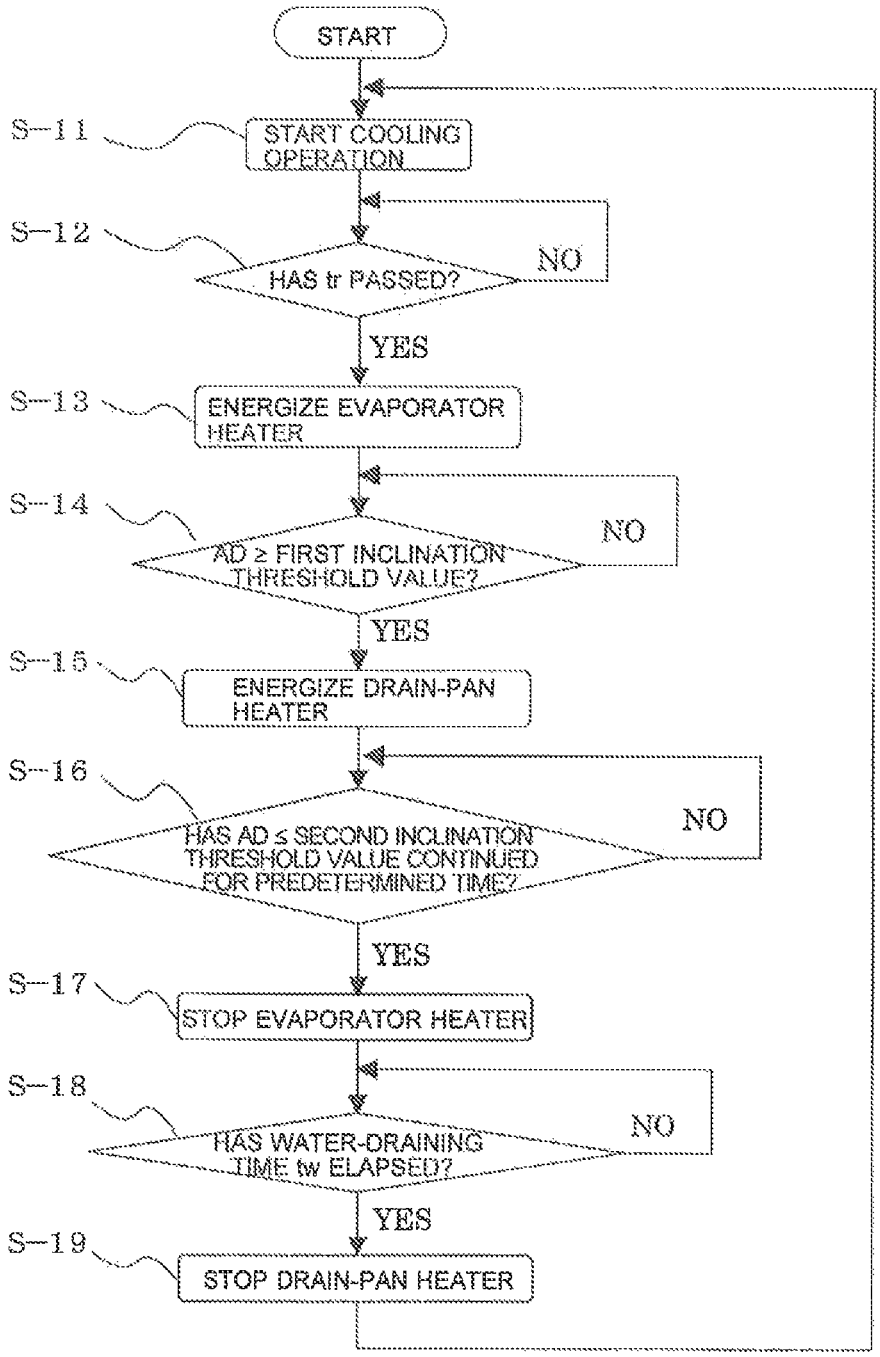
FIG. 14 is a flowchart illustrating an operation action based on an output of frost detecting means in a refrigerating and air-conditioning apparatus according to Embodiment 2.

FIG. 14 is a flowchart illustrating an operation action based on an output of the frost detecting means 22 in a refrigerating and air-conditioning apparatus according to Embodiment 2. A schematic diagram and a block diagram of the refrigerating and air-conditioning apparatus 1 according to Embodiment 2 are the same as those in Embodiment 1. The following description will be mainly directed to parts of operation in Embodiment 2 that are different from those in Embodiment 1.

Before describing the flowchart of the operation control of Embodiment 2, changes in the output of the frost detecting means 22 at its initial state and at its aged degraded state will be described.

Figure 15:
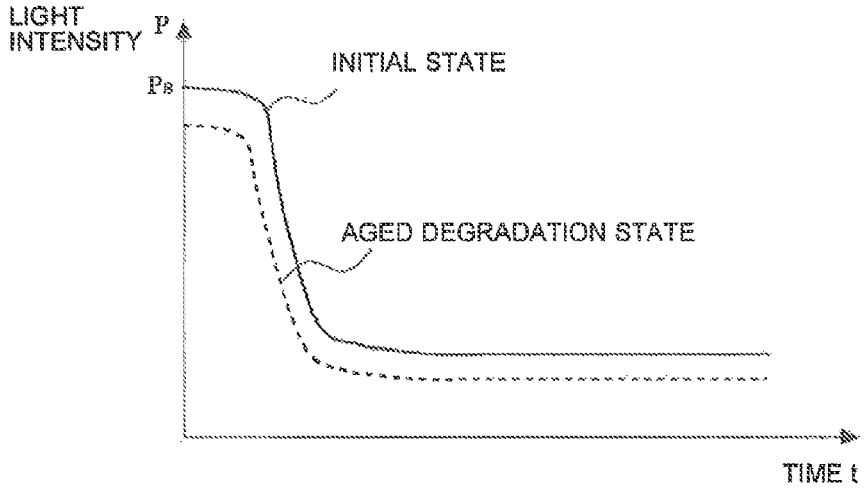
FIG. 15 illustrates a change in light intensity (or may be the relationship between voltage and time) when changing from a state in which frost is adhered to the surfaces of the fins 5*a* to a state in which there is no frost, from a start of the defrosting operation, and shows the light intensity at an initial state and at an aged degraded state of the frost detecting means.

FIG. 15 illustrates a change in light intensity or may be the relationship between voltage and time) when changing from a state in which frost is adhered to the surfaces of the fins 5*a* to a state in which there is no frost, from start of the defrosting operation. A solid line denotes the initial state, and a dotted line denotes the aged degraded state.

As shown in FIG. 15, in the aged degraded state, the quantity of light received by the light-receiving element 22*b* is reduced, as compared with the initial state, due to the effect of stains or the like on the optical surface of the light-receiving element 22*b* in the frost detecting means 22, resulting in reduced light intensity P. Although an absolute value of the light intensity P is different between the initial state and the aged degraded state, the manner in which the light intensity P changes is substantially the same between the two states. Specifically, even if the absolute value of the light intensity (voltage) relative to the frosting condition is different due to aged degradation, the gradient of change in the light intensity (voltage) from the start of defrosting operation to time ta at which the frost on the evaporator 5 starts to melt, that is, the inclination of the light intensity (voltage), is substantially the same.

Moreover, the inclination of the light intensity (voltage) when the light intensity (voltage) starts to decrease rapidly is also substantially the same between the initial state and the aged degraded state. Embodiment 2 utilizes this point, such that defrosting control of the evaporator 5 and heating control of the drain pan 23 are performed by determining the frosting condition on the basis of the inclination of the light intensity (voltage).

Figure 16:
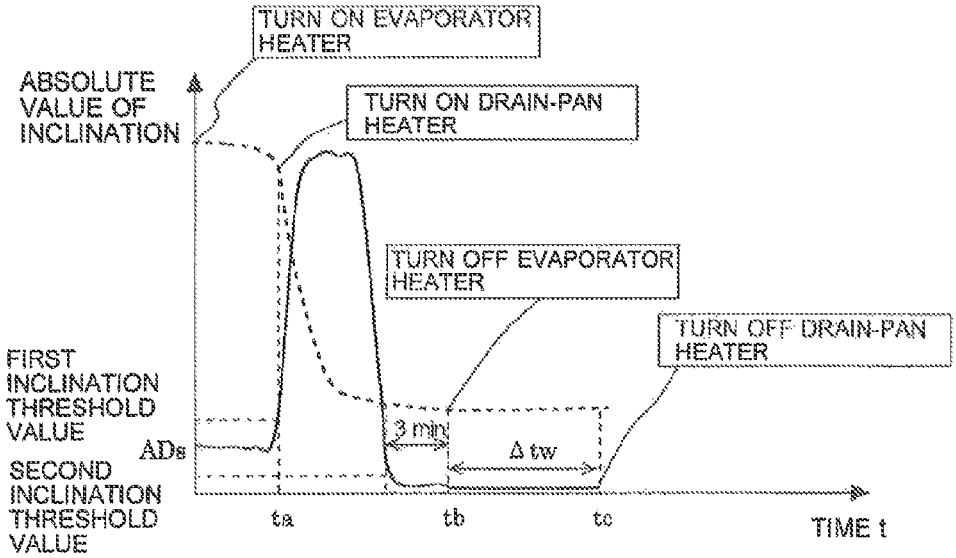
FIG. 16 illustrates a gradient (inclination) of change in the light intensity during defrosting operation and the ON and OFF timings of the evaporator heater and the drain-pan heater in the refrigerating and air-conditioning apparatus according to Embodiment 2.

The operation action based on an output of the frost detecting means 22 in the refrigerating and air-conditioning apparatus according to Embodiment 2 will be described below with reference to the flowchart of FIG. 14. FIG. 16 illustrates a change in the absolute value of the inclination of the light intensity when control is performed in accordance with the flowchart of FIG. 14, and shows ON and OFF timings of the evaporator heater 21 and the drain-pan heater 24. In FIG. 16, a solid line denotes a change in the absolute value of the inclination, whereas a dotted line denotes a change in the light intensity for reference.

Upon receiving a command to start the cooling operation (S-11), the control device 25 determines whether or not the cooling time has reached a predetermined time tr (S-12). This time tr is set as a time at its limit to allow a desired cooling capacity to be maintained (corresponding to a limit time at which the desired cooling capacity cannot be obtained if the time becomes greater than or equal to this time). If it is determined that tr has elapsed, defrosting operation is started. Specifically, the evaporator heater 21 is energized so as to defrost the evaporator 5 (S-13).

After energizing the evaporator heater 21, the control device 25 successively calculates an absolute value AD of the inclination of the light intensity (voltage) (the degree of change in the light intensity relative to time) from the current output of the light-receiving element 22*b* of the frost detecting means 22 and several pieces of past output data. If the absolute value AD changes rapidly, that is, if the absolute value AD becomes greater than or equal to a first predetermined inclination threshold value (e.g., a value that is several times (e.g., 1.5 times) an absolute value ADs of the inclination in the initial state of the operation in this example) (S-14), it is determined that the light intensity (voltage) has rapidly decreased because the frost has started to melt, thus starting the energization of the drain-pan heater 24 (S-15). This time corresponds to ta described above. With regard to the several pieces of past output data, it is desirable to use past 30 pieces of data or so. However, past 20 pieces of data or past 10 pieces of data are also acceptable so long as the inclination can be accurately calculated. Although the inclination is desirably calculated by using the least-squares method as in the following equation, other methods are also permissible so long as the inclination can be accurately calculated.

[Math. 2]

$$|AD| = \left| \frac{n\sum_{i=1}^{n} t_i P_i - \sum_{i=1}^{n} t_i \sum_{i=1}^{n} P_i}{n\sum_{i=1}^{n} t_i^2 - \left(\sum_{i=1}^{n} t_i\right)^2} \right|$$

where $t_i$ denotes time, and $P_i$ denotes light intensity.

Then, if a state in which the absolute value AD of the inclination is smaller than or equal to a second predetermined inclination threshold value (e.g., 0.001) continues for several minutes (e.g., 3 minutes) (S-16), the control device 25 determines that there is no frost or dew on the evaporator 5 and that the light intensity (voltage) has stabilized, stops the energization of the evaporator heater 21 (S-17), and ends the defrosting operation of the evaporator 5. This time corresponds to tb described above. With regard to several pieces of past data, it is desirable to use past 30 pieces of data or so. However, past 20 pieces of data or past 10 pieces of data are also acceptable so long as the inclination can be accurately calculated. The first inclination threshold value and the second inclination threshold value may be set on the basis of a measurement result obtained by performing tests in advance to measure the change in the light intensity P after the start of defrosting operation.

Subsequently, the control device 25 determines whether or not a predetermined water-draining time Δtw has elapsed after stopping the energization of the evaporator heater 21 (S-18). Then, when the water-draining time Δtw has elapsed, the energization of the drain-pan heater 24 is stopped (S-19), whereby the defrosting operation is ended at time tc at which the cooling operation is resumed.

In the related art determining when to end the defrosting operation using a temperature sensor, if the defrosting time required in the control in which the simultaneous energization of the evaporator heater 21 and the drain-pan heater 24 and simultaneous stopping of the energization is defined as td, Embodiment 2 is similar to Embodiment 1 in that the energization time of the evaporator heater 21 is shortened by (td−tb) seconds, and the energization time of the drain-pan heater 24 is shortened by (ta+(td−tc)) seconds, as shown in FIG. 13.

Furthermore, for example, when an operation is performed in a state where the refrigerated warehouse temperature is 0° C. and the evaporating temperature is −20° C., as in Embodiment 1, time ta at which the frost starts to melt is at about 350 seconds, time tb at which the frost is removed from the evaporator 5 is at about 1100 seconds, and time to at which water-draining is completed is at about 1600 seconds. In this case, because the defrosting time td in normal control is at about 1800 seconds, the energization time of the evaporator heater is shortened by 700 seconds (39%), and the energization time of the drain-pan heater 24 is shortened by about 550 seconds (31%).

Accordingly, in Embodiment 2, advantages similar to those in Embodiment 1 can be achieved, and the frosting condition is determined by using the inclination of the light intensity (voltage) instead of using the absolute value of the light intensity (voltage) obtained by the frost detecting means 22, thereby eliminating the effect of aged degradation as well as allowing constant stable control.

Although, in Embodiment 2, the ON timing of the evaporator heater 21 is set on the basis of time tr after the start of cooling operation, this timing may alternatively be set on the basis of the detection result of the frost detecting means 22, as in Embodiment 1. Specifically, the defrosting operation and the heating control of the drain pan 23 may be performed by appropriately combining Embodiment 1 and Embodiment 2.

In Embodiment 1 and Embodiment 2, the OFF timing of the drain-pan heater 24 is set on the basis of the predetermined water-draining time. The water-draining time is set with enough time for properly completing water-draining. However, because the water-draining time actually has a correlation with the amount of frost formed, the water-draining time may be allowed to vary in accordance with the amount of frost formed during operation. Specifically, although the water-draining time needs to be set longer if a large amount of frost is formed, the water-draining time can be shortened if a small amount of frost is formed. Since the evaporator heater 21 is turned on after time tr has passed from the start of cooling operation in Embodiment 2, the amount of frost formed at the time the evaporator heater 21 is turned on varies depending on the usage environment. This variation in the amount of frost becomes evident as a variation in time ta at which the frost starts to melt after the start of defrosting operation. Therefore, by preliminarily determining the relationship between time ta and the amount of frost as well as the relationship between the amount of frost and the water-draining time so as to determine time ta at which the frost starts to melt after the start of defrosting operation during the actual operation, the water-draining time may be estimated and set from an amount of frost estimated from time ta. Consequently, the water-draining time can be set in accordance with the amount of frost, so that the cooling operation can be resumed at an appropriate timing, thereby suppressing quality degradation of the stored items.

Figure 17:
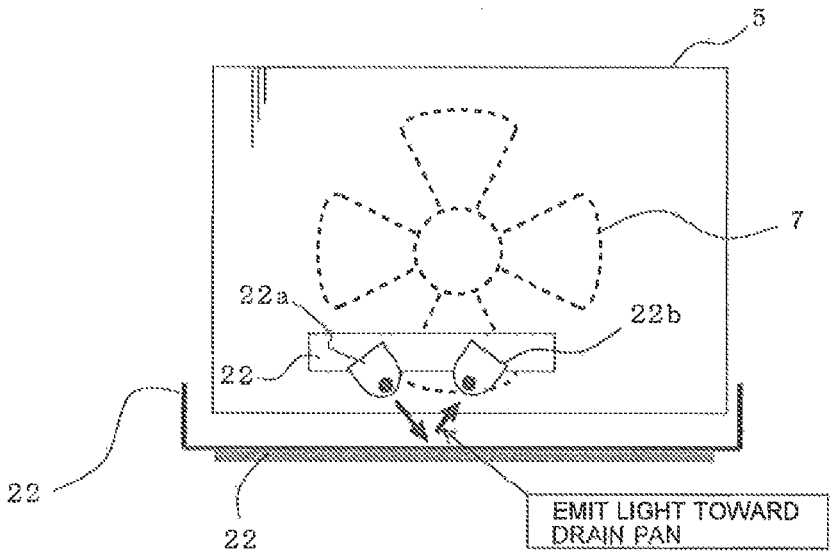
FIG. 17 illustrates another installation example of the frost detecting means.

Furthermore, in Embodiment 1 and Embodiment 2, the frost detecting means 22 may be disposed so as to face the drain pan, as shown in FIG. 17. In this case, the frost detecting means 22 may determine the presence of drain-water so as to determine the OFF timing of the drain-pan heater 24.

Figure 18:
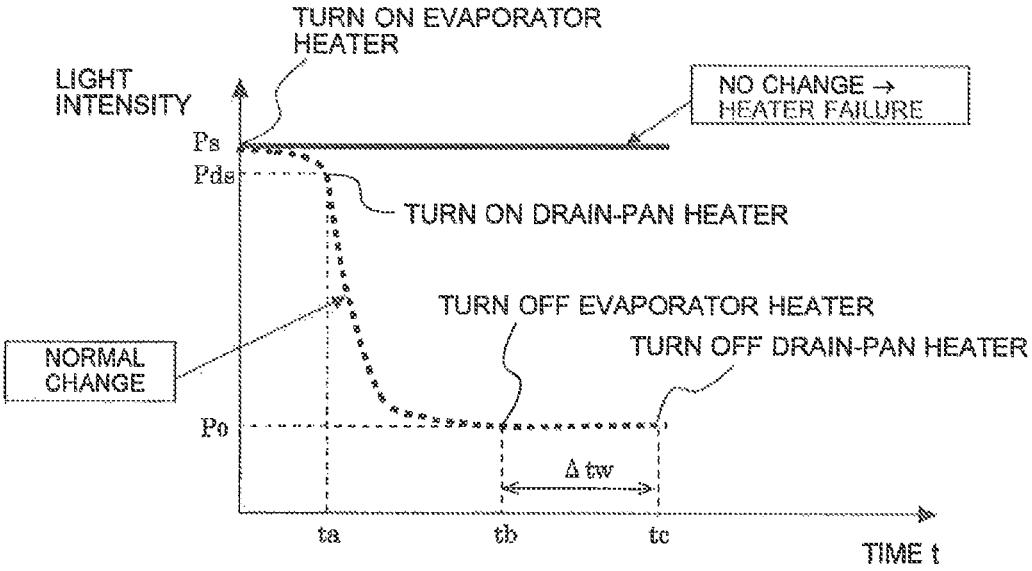
FIG. 18 illustrates a frost detection output when there is failure in the evaporator heater.

Furthermore, in Embodiment 1 and Embodiment 2, if there is no change in the sensor output regardless of the fact that the defrosting operation has started, as shown in FIG. 18, it may be determined that the evaporator heater 21 has failed. Thus, the user can be immediately notified of the failure.

Embodiment 3

In Embodiment 1 and Embodiment 2 described above, the OFF timing of the evaporator heater 21 is determined on the basis of the absolute value of the light intensity (voltage) obtained by the frost detecting means 22 or the absolute value of the inclination thereof. On the other hand, in Embodiment 3, the OFF timing of the evaporator heater 21 is determined on the basis of the drain-pan temperature.

Figure 19:
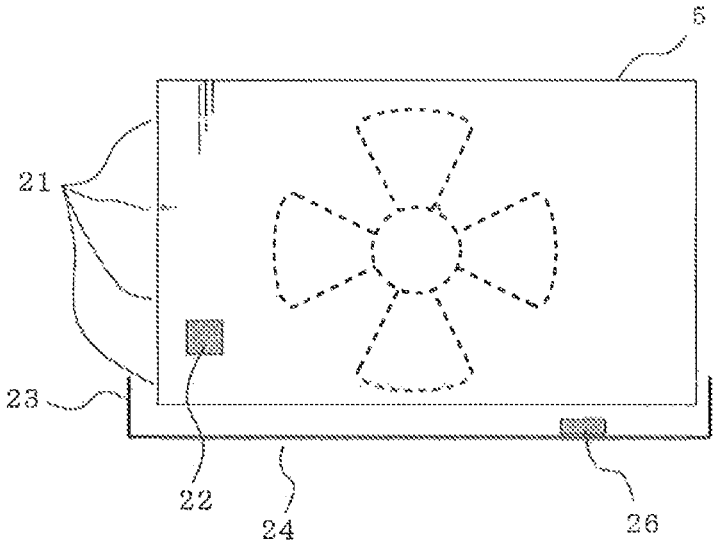
FIG. 19 is a front view of a surrounding area including an evaporator in a refrigerating and air-conditioning apparatus according to Embodiment 3 of the invention.
Figure 20:
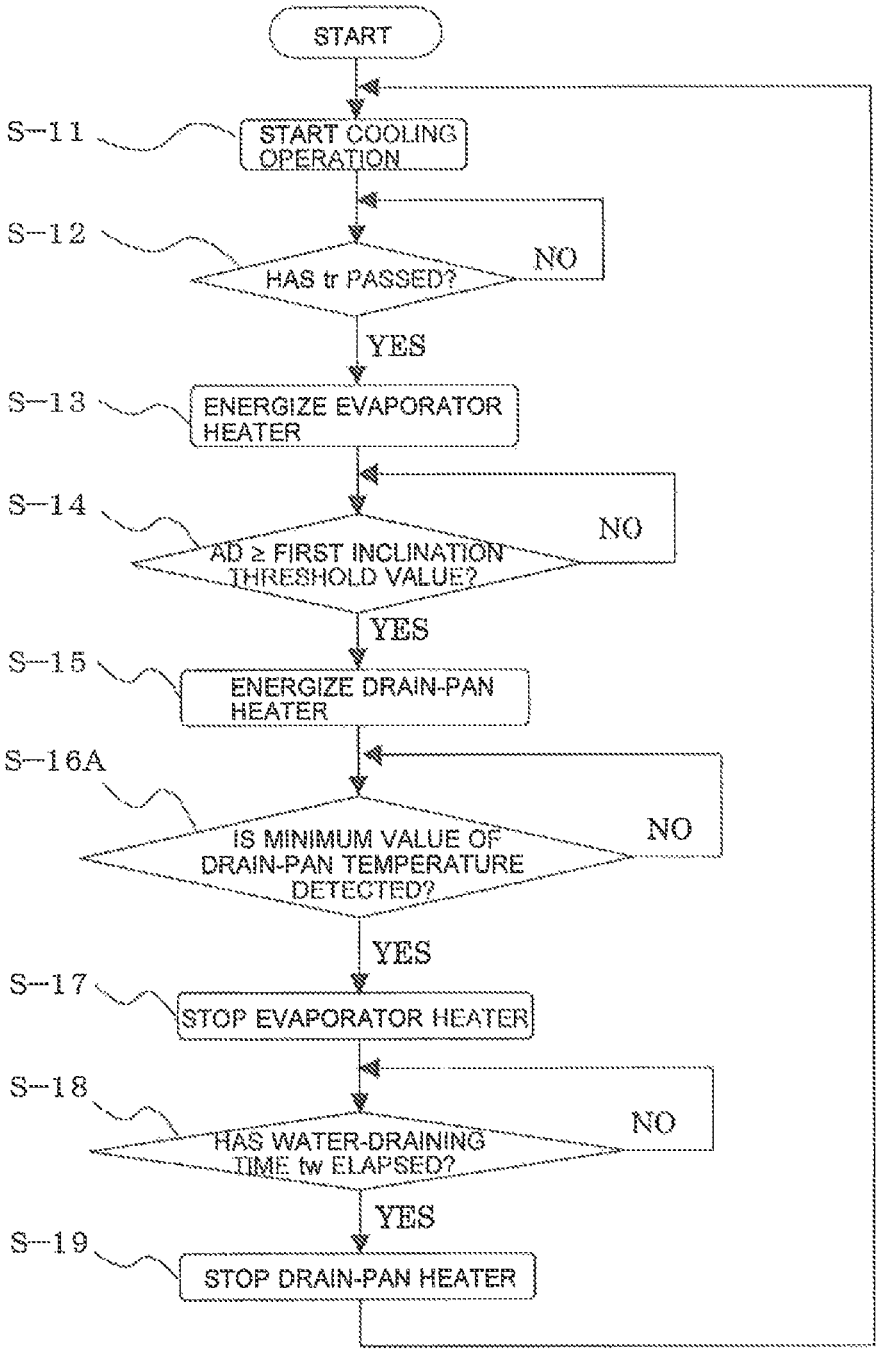
FIG. 20 is a flowchart illustrating an operation action performed in the refrigerating and air-conditioning apparatus according to Embodiment 3.

FIG. 19 is a front view of a surrounding area including an evaporator in a refrigerating and air-conditioning apparatus according to Embodiment 3 of the invention. FIG. 20 is a flowchart illustrating an operation action performed in the refrigerating and air-conditioning apparatus according to Embodiment 3. In FIG. 20, steps that are the same as those in Embodiment 2 shown in FIG. 14 are given the same step numbers.

In addition to the components in Embodiment 1 and Embodiment 2, the refrigerating and air-conditioning apparatus according to Embodiment 3 further includes drain-pan-temperature detecting means 26 that detects the temperature of the drain pan 23. Other components are similar to Embodiment 1 and Embodiment 2. The modifications applied to similar components in Embodiment 1 and Embodiment 2 may be similarly applied to Embodiment 3.

Figure 21:
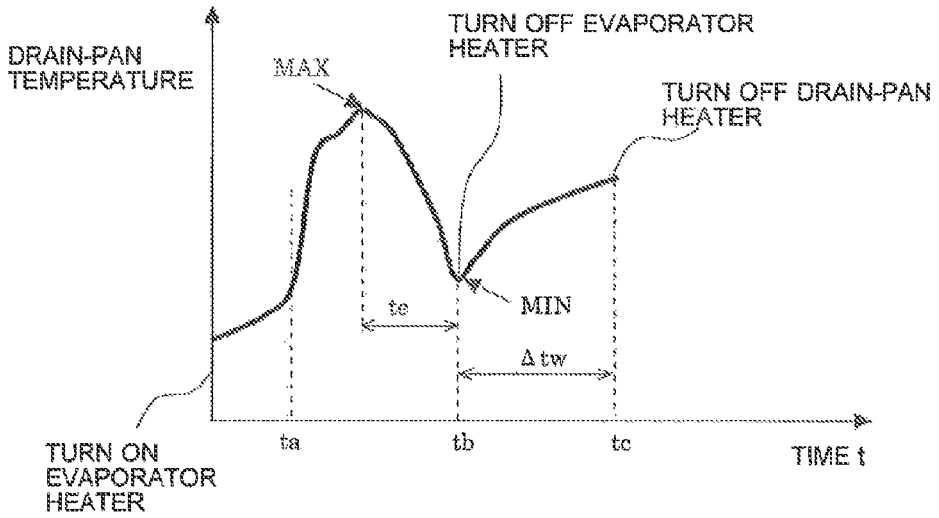
FIG. 21 illustrates a temporal change in drain-pan temperature detected by drain-pan-temperature detecting means in FIG. 20.

FIG. 21 illustrates a temporal change in the drain-pan temperature detected by the drain-pan-temperature detecting means in FIG. 20. A change in the light intensity P detected by the frost detecting means 22 is the same as that in FIG. 12.

A detection value of the drain-pan-temperature detecting means 26 increases with the start of the defrosting operation (with the turning on of the evaporator). After turning on the drain-pan heater 24, the detection value further increases until reaching MAX. Then, as the frost on the evaporator 5 melts and drips onto the drain pan 23, the detection value begins to decrease. As the defrosting operation progresses, the detection value of the drain-pan-temperature detecting means 26 decreases. When the defrosting operation of the evaporator 5 is ended and there is no more supply of defrosted water to the drain pan 23, the detection value of the drain-pan-temperature detecting means 26 begins to increase again. Because the detection value of the drain-pan-temperature detecting means 26 has such variable characteristics, timing tb at which the detection value of the drain-pan-temperature detecting means 26 begins to increase again after decreasing may be set as the OFF timing of the evaporator heater 21.

The flowchart of FIG. 20 will be described below. The following description will be mainly directed to parts of operation in Embodiment 3 that are different from those in Embodiment 2.

Steps S-11 to S-15 are the same as those in Embodiment 2. In Embodiment 3, after energizing the drain-pan heater 24 (S-15), the control device 25 detects a minimum value (detects a timing at which the temperature changes from a decreasing state to an increasing state) from time-series data of the temperature detected by the drain-pan-temperature detecting means 26 so as to detect the aforementioned timing tb (S-16A). Upon detecting the minimum value of the temperature change in the drain pan 23, the control device 25 stops the energization of the evaporator heater 21 (S-17). The subsequent process is the same as that of Embodiment 2.

In the related art determining when to end the defrosting operation using a temperature sensor, if the defrosting time required in the control in which the simultaneous energization of the evaporator heater 21 and the drain-pan heater 24 and simultaneous stopping of the energization is defined as td, then, the energization time of the evaporator heater 21 is shortened by (td−tb) seconds, and the energization time of the drain-pan heater 24 is shortened by (ta+(td−tc)) seconds in Embodiment 3, as shown in FIG. 13.

For example, when an operation is performed in a state where the refrigerated warehouse temperature is 0° C. and the evaporating temperature is −20° C., as in Embodiment 1 and Embodiment 2, time ta at which the frost starts to melt is at about 350 seconds, time tb at which the frost is removed from the evaporator is at about 1100 seconds, and time to at which water-draining is completed is at about 1600 seconds. In this case, because the defrosting time td in normal control is at about 1800 seconds, the energization time of the evaporator heater is shortened by 700 seconds (39%), and the energization time of the drain-pan heater 24 is shortened by about 550 seconds (31%). Accordingly, with the shortened energization time of the heaters, power consumption can be reduced, and temperature increase in the refrigerated warehouse can be suppressed.

In Embodiment 3, with regard to a change in the temperature detected by the drain-pan-temperature detecting means 26 in FIG. 21, the amount of frost can be estimated from the time te it takes from when the detection value is MAX to when the detection value reaches the minimum value (MIN in FIG. 21). Therefore, the water-draining time may be set on the basis of the amount of frost estimated from the time te. Consequently, the water-draining time can be set in accordance with the amount of frost, so that the cooling operation can be resumed at an appropriate timing, thereby suppressing quality degradation of the stored items.

Embodiment 4

Embodiment 4 proposes a method for determining a defrosting start timing different from that in each of Embodiment 1, Embodiment 2, and Embodiment 3.

Before describing a refrigerating and air-conditioning apparatus according to Embodiment 4, a normal defrosting start timing will be described.

Figure 22:
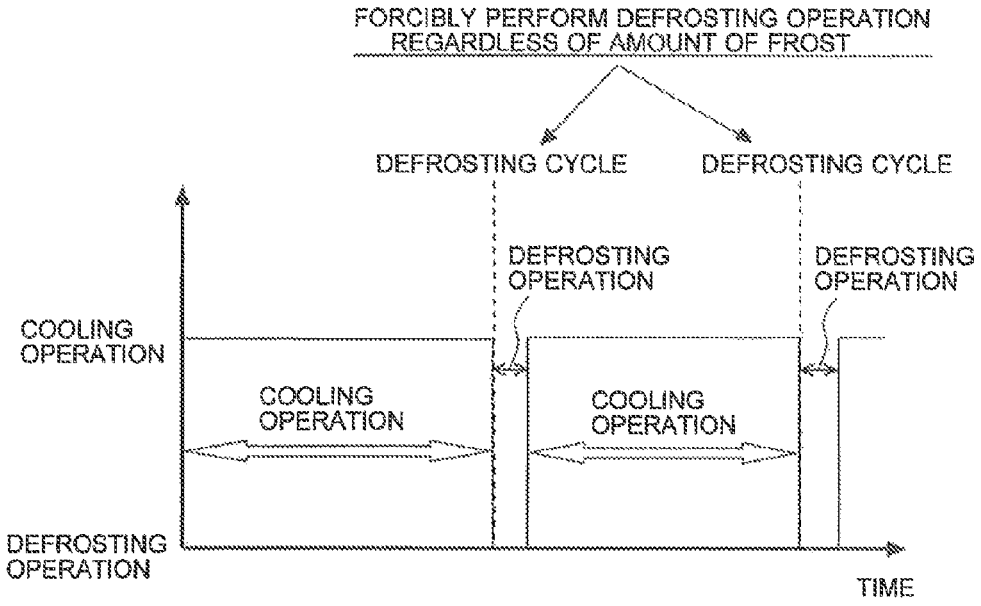
FIG. 22 illustrates a normal defrosting start timing of the related art.

FIG. 22 illustrates a normal defrosting start timing of the related art.

Normally, a defrosting cycle, from the start of a defrosting operation to the start of the next defrosting operation, is set, as shown in FIG. 22, such that defrosting operation is periodically started according to the defrosting cycle, regardless of the frosting condition. Specifically, even if there is only a small amount of frost and defrosting is thus not necessary, defrosting operation is forcibly performed when a defrosting start timing of the defrosting cycle is reached. This may lead to problems such as increased power consumption and quality degradation of the stored items caused by temperature increase in the refrigerated warehouse.

In Embodiment 4, when the defrosting start timing of the defrosting cycle is reached, the frosting condition is detected by the frost detecting means 22 so as to determine whether or not defrosting operation is necessary, and defrosting operation is started only if it is determined to be necessary. For determining whether or not defrosting operation is necessary, a frost formation speed determined from the current operating time measured from the start of cooling operation and a frost layer thickness detected by the frost detecting means 22 is used. A detailed description of this determination method will be provided below.

Figure 23:
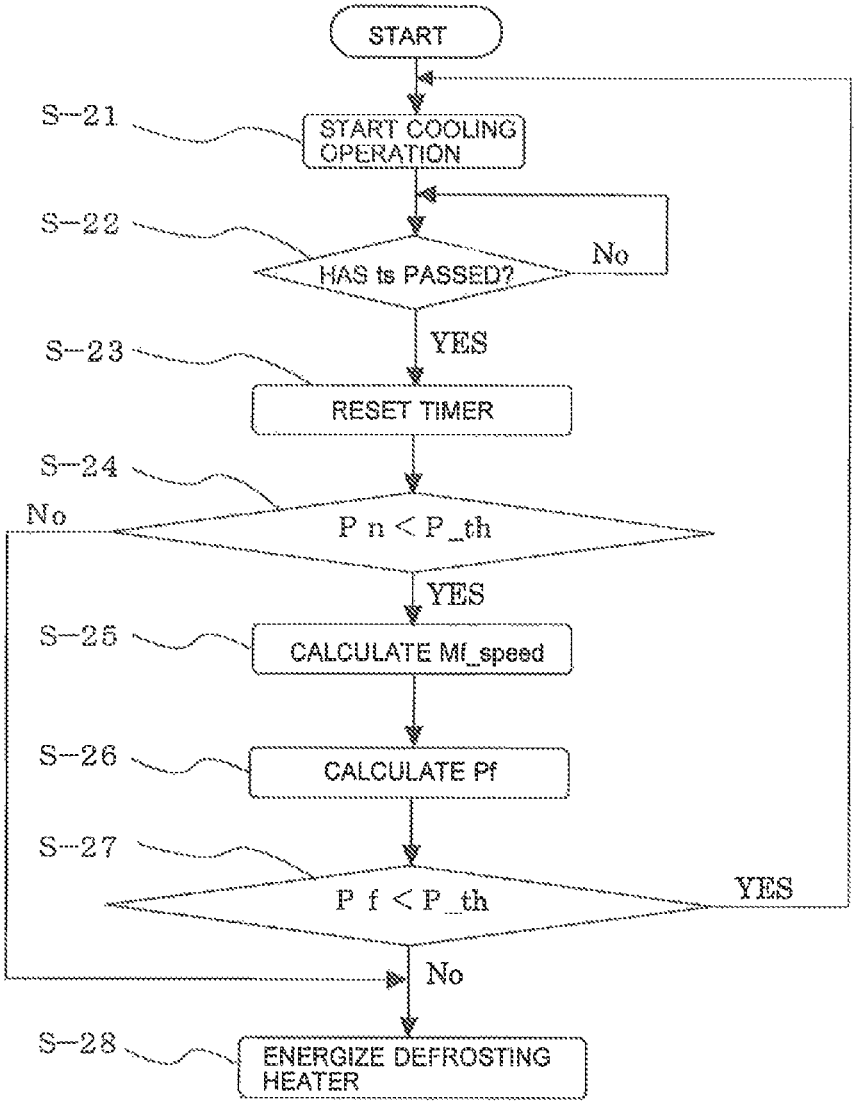
FIG. 23 is a flowchart illustrating a method for determining a defrosting start timing in a refrigerating and air-conditioning apparatus according to Embodiment 4.
Figure 24:
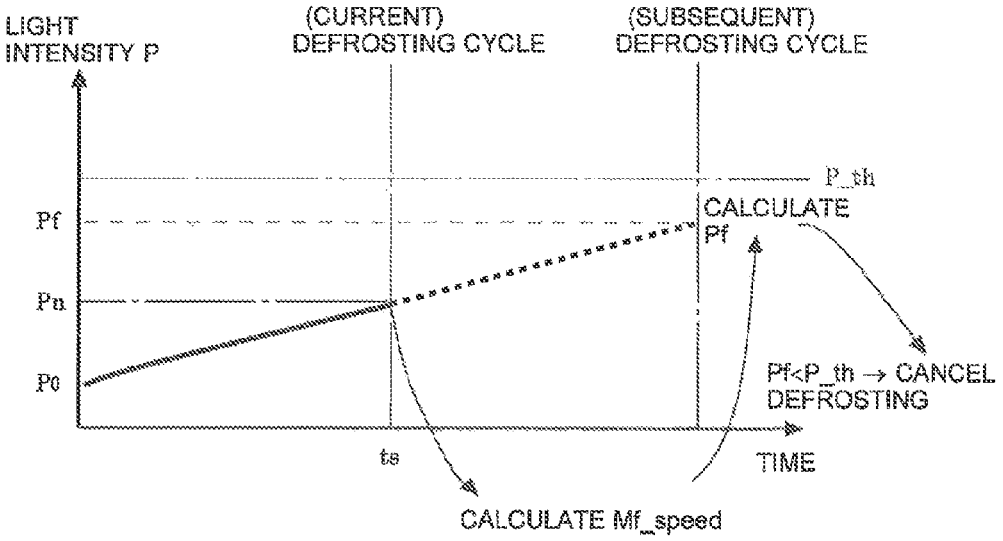
FIG. 24 is a diagram illustrating a change in light intensity (voltage) P of the frost detecting means from the start of cooling operation.

FIG. 23 is a flowchart illustrating the method for determining a defrosting start timing of the refrigerating and air-conditioning apparatus according to Embodiment 4. FIG. 24 illustrates a change in the light intensity (voltage) P obtained by the frost detecting means from after the start of cooling operation. A schematic diagram and a block diagram of the refrigerating and air-conditioning apparatus 1 according to Embodiment 4 are the same as those in Embodiment 1. The configuration may be the same as that in Embodiment 3 provided with the drain-pan-temperature detecting means 26. The modifications applied to similar components in Embodiment 1, Embodiment 2, and Embodiment 3 may be similarly applied to Embodiment 4. The method for determining a defrosting start timing of the refrigerating and air-conditioning apparatus according to Embodiment 4 will be described below with reference to FIGS. 23 and 24.

Upon receiving a command to start the cooling operation from the input operation means (S-21), the control device 25 determines whether the cooling time has reached a predetermined time (defrosting cycle) ts (S-22). If it is determined that ts has passed, a timer for counting defrosting cycles is reset (S-23). Subsequently, a current light intensity (voltage) Pn obtained by the frost detecting means 22 and a predetermined threshold value P_th, to be described later, are compared (S-24). If Pn is greater than or equal to P_th, it is determined that defrosting operation is necessary, and the defrosting operation is started immediately (S-27). On the other hand, if Pn is smaller than P_th, the following process is performed before starting the defrosting operation.

First, a frost formation speed Mf_speed is calculated from the following equation by using the current light intensity (voltage) Pn obtained by the frost detecting means 22, the operating time ts, and the light intensity $P_0$ when there is no frost (S-25).

$$\text{Mf_speed} = \frac{Pn - P0}{tr} \quad \text{[Math. 3]}$$

Then, an estimated light intensity (voltage) Pf of the frost detecting means 22 in a subsequent defrosting cycle is determined from the following equation by using the frost formation speed Mf_speed and a subsequent cooling time (defrosting cycle) is (S-26).

$$Pf = Mf_speed \times tr + Pn \quad \text{[Math. 4]}$$

It is determined whether or not the estimated light intensity Pf is smaller than the threshold value P_th (S-27). If the estimated light intensity Pf is smaller than the threshold value P_th, that is, if it is estimated that the light intensity (voltage) detected by the frost detecting means 22 may be smaller than the threshold value P_th when defrosting operation is started in the subsequent defrosting cycle, the defrosting operation is cancelled so as to continue the cooling operation. Because the cooling time is reset in S-23, a counting process for a new cooling time begins from this point.

The light intensity detected by the frost detecting means 22 and the amount of frost have a correlative relationship. Therefore, the light intensity can be converted to the frost layer thickness. As such, the estimated light intensity Pf is a value corresponding to an estimated frost-layer-thickness value at the start of the subsequent defrosting operation. Therefore, in step S-27 and onward, if it is estimated that the estimated frost-layer-thickness value at the start of the subsequent defrosting operation is smaller than a predetermined frost layer thickness, it is determined that defrosting operation is not necessary at the present time, thus cancelling the defrosting operation.

If the estimated light intensity Pf is greater than or equal to the threshold value P_th, that is, if it is estimated that the light intensity (voltage) detected by the frost detecting means 22 may be greater than or equal to the threshold value P_th in the subsequent defrosting cycle, the evaporator heater 21 is energized (defrosting operation is started) so as to prevent the light intensity (voltage) from becoming greater than or equal to the threshold value P_th in the subsequent defrosting cycle (S-28). The process to be performed after starting the defrosting operation is not particularly limited in Embodiment 4, and the process in Embodiment 1, 2, or 3 may be appropriately employed.

For example, the threshold value P_th is determined from the following equation by using a light intensity (voltage) P_limit detected by the frost detecting means 22 that is a frost layer thickness at its limit to allow the cooling capacity be obtained to maintain the refrigerated warehouse 11 to a set temperature, and a safety factor α%.

$$\text{P_th} = \text{P_limit} \times \frac{100 - \alpha}{100} \quad \text{[Math. 5]}$$

Figure 25:
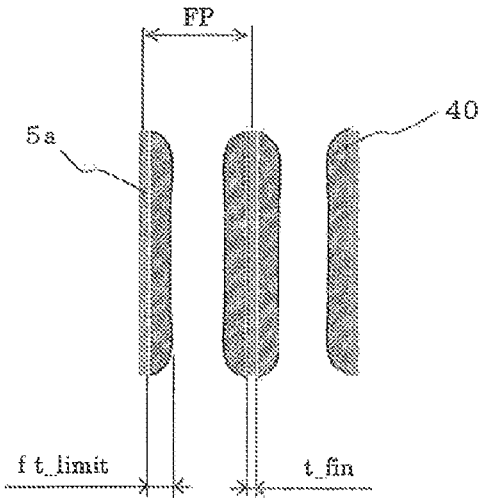
FIG. 25 illustrates dimensions used in an equation for calculating P_limit.

P_limit is determined from the following equation. FIG. 25 illustrates dimensions used in the following equation and shows a state in which frost 40 is adhered to the fins 5*a* of the evaporator 5.

$$\text{P_limit} = (P\max - P0) \times \frac{2 \times \text{ft_limit}}{FP - \text{t_fin}} - P0, \quad \text{[Math. 6]}$$

where Pmax denotes the light intensity (voltage) detected by the frost detecting means 22 when the gaps between the fins 5*a* are completely blocked, $P_0$ denotes the light intensity (voltage) when there is no frost, ft_limit denotes the frost layer thickness at its limit to allow the cooling capacity be obtained to maintain the refrigerated warehouse 11 to a set temperature, FP denotes the pitch of the fins, and t_fin denotes the thickness of each fin.

The values ft_limit, FP, and t_fin are determined in accordance with the structure of the evaporator 5. The value ft_limit is, in a case of a unit cooler with a pitch of 4 mm between the fins, for example, about 1 mm, which is a frost layer thickness that blocks the gaps between the fins 5*a* by about 50%.

According to Embodiment 4, since the defrosting start timing is determined by using the frost formation speed Mf_speed, which is operational state data of the refrigerating and air-conditioning apparatus, a defrosting start timing suitable for the characteristics of the evaporator 5 and the usage environment can be set.

Furthermore, even when the defrosting start timing of the defrosting cycle is reached, if it is estimated that the frost layer thickness corresponding to a subsequent defrosting start timing is smaller than the frost layer thickness at its limit to allow the cooling capacity be obtained to maintain the refrigerated warehouse 11 to a set temperature, the defrosting operation is cancelled so as to continue the cooling operation. This suppresses waste of power consumption, thereby allowing increased energy efficiency. Furthermore, since defrosting operations at unnecessary timings are cancelled, temperature increase in the refrigerated warehouse can be suppressed, whereby quality degradation of the stored items can be suppressed.

Figure 26:
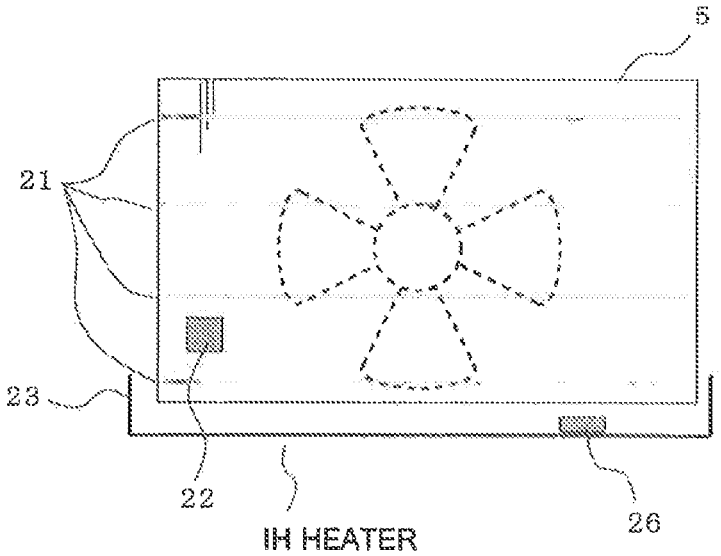
FIG. 26 illustrates an example in which an IH heater is used as a drain-pan heating device.

Although a heater is used as a drain-pan heating device in Embodiment 1, Embodiment 2, Embodiment 3, and Embodiment 4 described above, an IH heater may specifically be used, as shown in FIG. 26. With the use of an IH heater, the heating efficiency is increased so that the energization time of the heater can be further shortened.

Figure 27:
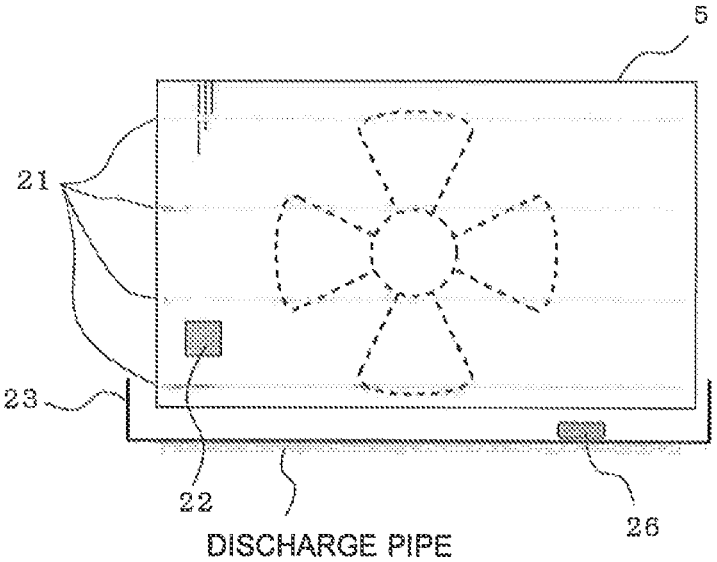
FIG. 27 illustrates an example in which a discharge pipe is used as a drain-pan heating device.

As a further alternative, for example, a discharge pipe that discharges a high-temperature high-pressure gas refrigerant from the compressor 2 may be used as the drain-pan heating device. In this case, as shown in FIG. 27, the discharge pipe is extended near the drain pan 23 or through the evaporator 5 so as to heat the drain pan 23. By using the high-temperature high-pressure gas refrigerant discharged from the compressor 2 as a heat source in this manner, heat collected from the air can be used, thereby allowing reduced power consumption.

Figure 28:
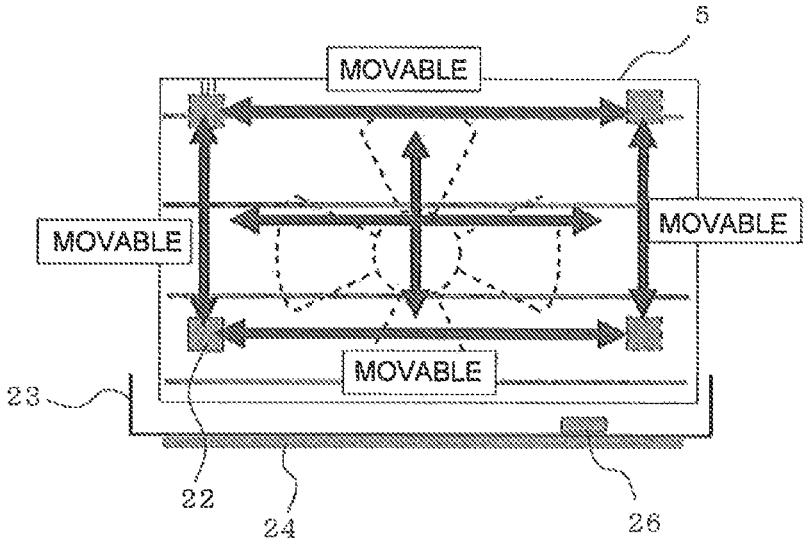
FIG. 28 illustrates an example in which the frost detecting means is attached to the evaporator in a movable manner in horizontal and vertical directions.

Furthermore, although the frost detecting means 22 is positionally fixed in each of Embodiment 1, Embodiment 2, Embodiment 3, and Embodiment 4 according to the invention, the frost detecting means 22 may be attached to the evaporator 5 in a movable manner in the horizontal and vertical directions, as shown in FIG. 28, so as to be capable of detecting the frosting condition over the entire evaporator. The progression of frost formation is not uniform throughout the entire evaporator 5, and is fast in some areas and slow in some areas. This is the same with regard to the progression of defrosting. Therefore, when determining the ON timings of the evaporator heater 21 and the drain-pan heater 24, the timings are determined by making the frost detecting means 22 detect the frosting condition in areas where the progression of frost formation is fast. When determining the OFF timings of the evaporator heater 21 and the drain-pan heater 24, the timings are determined by making the frost detecting means 22 detect the frosting condition in areas where the progression of defrosting is slow. This allows more accurate determination.

The kind of refrigerant circulating through the refrigeration cycle in the invention is not limited, and may be a natural refrigerant, such as carbon dioxide, hydrocarbon, or helium, an alternative refrigerant not containing chlorine, such as HFC410A or HFC407C, or a fluorocarbon refrigerant used in existing products, such as R22 or R134a.

Furthermore, the compressor 2 may be of various types, such as a reciprocating type, a rotary type, a scroll type, or a screw type, and may be of a type whose rotation speed is variable or of a type whose rotation speed is fixed.

Although Embodiment 1 to Embodiment 4 are described as individual embodiments, the refrigerating and air-conditioning apparatus may be formed by appropriately combining the characteristic configurations and process of the embodiments. For example, Embodiment 3 is characterized in that the OFF timing of the evaporator heater 21 is determined on the basis of the drain-pan temperature. Thus, Embodiment 1 and Embodiment 3 may be combined so as to replace the determination process of S-6 in FIG. 11 with the determination process of S-16A in FIG. 20.

REFERENCE SIGNS LIST

1 refrigerating and air-conditioning apparatus; 2 compressor; 3 condenser; 4 expansion valve; 5 evaporator; 5*a* fin; 6 condenser fan; 7 evaporator fan; 11 refrigerated warehouse; 21 evaporator heater; 22 frost detecting means; 22*a* light-emitting element; 22*b* light-receiving element; 23 drain pan; 24 drain-pan heater; 25 control device; 26 drain-pan-temperature detecting means 40 frost.

The invention claimed is:

1. A refrigerating and air-conditioning apparatus comprising:

a refrigeration cycle being formed by connecting a compressor, a condenser, an expansion valve, and an evaporator, the refrigeration cycle performing a cooling operation;

an evaporator heating device heating the evaporator;

a drain pan receiving drain-water from the evaporator and draining the drain-water;

a drain-pan heating device heating the drain pan;

a frost detecting device including a light-emitting element that emits light to the evaporator and a light-receiving element that receives reflected light from the evaporator and outputs a voltage according to the reflected light;

a control device controlling on-off operation of the evaporator heating device and the drain-pan heating device, the control device, being configured to turn on the evaporator heating device based on the output of the frost detecting device, and then, calculate an inclination of an output voltage of the frost detecting device successively, determine that the frost formed on the evaporator has started to melt when the inclination is 1.5 times or more of an absolute value of an inclination of initial operation, and turn on the drain-pan heating device.

2. The refrigerating and air-conditioning apparatus of claim 1, wherein based on the output of the frost detecting device, if the control device determines that the frosting condition on the evaporator has reached a frosting condition that is at a limit to allow a desired cooling capacity be maintained, the control device turns on the evaporator heating device and does not turn on the drain-pan heating device.

3. The refrigerating and air-conditioning apparatus of claim 2, wherein if an output voltage V from the frost detecting device or a light intensity P calculated from the output voltage V is greater than or equal to a predetermined voltage Von or a predetermined light intensity Ps, the control device determines that the frosting condition on the evaporator has reached a frosting condition that is at a limit to allow a desired cooling capacity be maintained.

4. The refrigerating and air-conditioning apparatus of claim 1, wherein if the control device determines that the frost is removed from the evaporator on the basis of an output of the frost detecting device after the evaporator heating device is turned on, the control device turns off the evaporator heating device.

5. The refrigerating and air-conditioning apparatus of claim 4, wherein if an output voltage V from the frost detecting device or a light intensity P calculated from the output voltage V is smaller than or equal to a predetermined voltage Voff or a predetermined light intensity Po after the evaporator heating device is turned on, the control device determines that the frost is removed from the evaporator.

6. The refrigerating and air-conditioning apparatus of claim 4, wherein if a state in which an inclination of an output voltage of the frost detecting device after the drain-pan heating device is turned on is smaller than or equal to a second inclination threshold value continues for a predetermined time, the control device determines that the frost is removed from the evaporator.

7. The refrigerating and air-conditioning apparatus of claim 1, further comprising a drain-pan-temperature detector, wherein if the control device detects that a temperature detected by the drain-pan-temperature detector after the evaporator heating device is turned on has reached a minimum value, the control device determines that the frost is removed from the evaporator and turns off the evaporator heating device.

8. The refrigerating and air-conditioning apparatus of claim 1, wherein when a predetermined water-draining time elapses after the evaporator heating device is turned off, the control device turns off the drain-pan heating device.

9. The refrigerating and air-conditioning apparatus of claim 1, wherein the control device is configured to store a relationship between a time from start of a defrosting operation to start of melting of the frost and an amount of frost in advance and to estimate an amount of frost based on the relationship and a time measured during an actual operation from the start of the defrosting operation to the start of melting of the frost, and wherein the control device is configured to store a relationship between an amount of frost and a draining time in advance, estimate an amount of water-draining time, on the basis of the relationship and the estimated amount of frost during the actual operation, and turn off the drain-pan heating device when the water-draining time elapses and the defrosting operation is terminated after the frost has started to melt.

10. The refrigerating and air-conditioning apparatus of claim 7, wherein the control device estimates an amount of frost from an amount of time from after a detection value obtained by the drain-pan-temperature detector becomes maximum until the detection value reaches the minimum value, sets a water-draining time on the basis of the estimated amount of frost, and turns off the drain-pan heating device when the water-draining time elapses after the evaporator heating device is turned off.

11. The refrigerating and air-conditioning apparatus of claim 1, wherein the drain-pan heating device utilizes a high-temperature high-pressure refrigerant discharged from the compressor.

12. The refrigerating and air-conditioning apparatus of claim 1, wherein the frost detecting device is attached to the evaporator in a movable manner so as to be capable of detecting the frosting condition of the entire evaporator.

* * * * *